US007362986B2

(12) United States Patent
Okabe et al.

(10) Patent No.: US 7,362,986 B2
(45) Date of Patent: Apr. 22, 2008

(54) PROCESS CARTRIDGE IN IMAGE-FORMING DEVICE

(75) Inventors: Yasushi Okabe, Nagoya (JP); Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 123 days.

(21) Appl. No.: 11/258,179

(22) Filed: Oct. 26, 2005

(65) Prior Publication Data

US 2006/0093399 A1 May 4, 2006

(30) Foreign Application Priority Data

Oct. 29, 2004 (JP) ..... 2004-317220
Aug. 1, 2005 (JP) ..... 2005-223222

(51) Int. Cl.
*G03G 21/16* (2006.01)

(52) U.S. Cl. ..... 399/111

(58) Field of Classification Search ..... 399/64, 399/107, 110, 111, 112, 119, 299
See application file for complete search history.

(56) References Cited

U.S. PATENT DOCUMENTS 5,771,429 A 6/1998 Oyama et al.
5,774,766 A * 6/1998 Karakama et al. ..... 399/111
5,875,378 A * 2/1999 Campbell et al. ..... 399/119 X
5,909,610 A * 6/1999 Yoshiki et al. ..... 399/111 X
5,943,528 A * 8/1999 Akutsu et al. ..... 399/110
6,122,470 A 9/2000 Kimura
6,137,973 A 10/2000 Nishiuwatoko et al.
6,151,459 A * 11/2000 Hashimoto et al. ..... 399/112 X
6,385,414 B1 5/2002 Sato et al.
6,553,189 B2 * 4/2003 Miyamoto et al. ..... 399/64 X
6,571,079 B2 * 5/2003 Nagaoka et al. ..... 399/299
6,625,413 B2 * 9/2003 Oguma et al. ..... 399/111 X
6,868,243 B2 3/2005 Watanabe et al.
7,139,498 B2 * 11/2006 Mashiba et al. ..... 399/299 X
2002/0041774 A1 4/2002 Higeta et al.

FOREIGN PATENT DOCUMENTS

| | | |
|---|---|---|
| EP | 1 168 108 | 1/2002 |
| JP | 5-53384 | 3/1993 |
| JP | 7239608 | 9/1995 |
| JP | 9230702 | 9/1997 |
| JP | 11109753 | 4/1999 |
| JP | 2000003092 | 1/2000 |
| JP | 2001100493 | 4/2001 |
| JP | 2001356660 | 12/2001 |
| JP | 2002116612 | 4/2002 |
| JP | 2002296991 | 10/2002 |
| JP | 2003098815 | 4/2003 |
| JP | 2003241622 | 8/2003 |

OTHER PUBLICATIONS

European Search Report relating to EP 05023562.1.

* cited by examiner

*Primary Examiner*—Sandra L. Brase
(74) *Attorney, Agent, or Firm*—Banner & Witcoff, Ltd.

(57) ABSTRACT

A cartridge that can be detachably mounted in an image-forming device includes: a first wall; a second wall opposing the first wall with a gap formed therebetween, the first wall and the second wall defining therebetween a developer-accommodating section that accommodates a developer; and a reinforcing part spanning between the first wall and the second wall.

32 Claims, 25 Drawing Sheets

PROCESS CARTRIDGE IN IMAGE-FORMING DEVICE

BACKGROUND OF THE INVENTION

1. Field of the Invention

The present invention relates to an image-forming device such as a laser printer, and a cartridge detachably mounted in the image-forming device.

2. Description of the Related Art

Some conventional electrophotographic image-forming devices such as laser printers provide various members used to perform image-forming processes in cartridges that can be detachably mounted in the main body of the image-forming device. In this way, the cartridges can be independently replaced as needed, based on the life span of the members accommodated therein. One such image-forming device disclosed in U.S. Pat. No. 6,385,414 B1 has a process cartridge provided with a toner-accommodating chamber for accommodating toner.

SUMMARY OF THE INVENTION

The toner-accommodating chamber is hollow in order to accommodate as much toner as possible. When the chamber is hollow, the walls of the chamber must be made thicker or non-planar in order to maintain the stiffness of the chamber and to prevent the chamber from easily becoming deformed. If the toner-accommodating chamber is deformed, toner accommodated in the chamber is ejected, resulting in toner leakage and other problems.

With the recent demands for more compact image-forming devices, the process cartridges must also be made more compact. However, by making the walls of the toner-accommodating chamber thicker or non-planar in order to maintain the stiffness of the chamber, the process cartridge is inevitably larger, making it difficult to meet demands for a more compact size.

In view of the foregoing, it is an object of the present invention to provide a cartridge capable of enhancing the stiffness of a developer-accommodating section. It is another object of the present invention to provide an image-forming device in which the cartridge can be detachably mounted.

In order to attain the above and other objects, the present invention provides a cartridge that can be detachably mounted in an image-forming device. The cartridge includes: a first wall; a second wall opposing the first wall with a gap formed therebetween, the first wall and the second wall defining therebetween a developer-accommodating section that accommodates a developer; and a reinforcing part spanning between the first wall and the second wall.

According to another aspect, the present invention provides an image-forming device, including: a housing; and the above-described cartridge that is detachably mounted in the housing.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A cartridge and an image forming device according to the preferred embodiments of the invention will be described with reference to the accompanying drawings.

Figure 1:
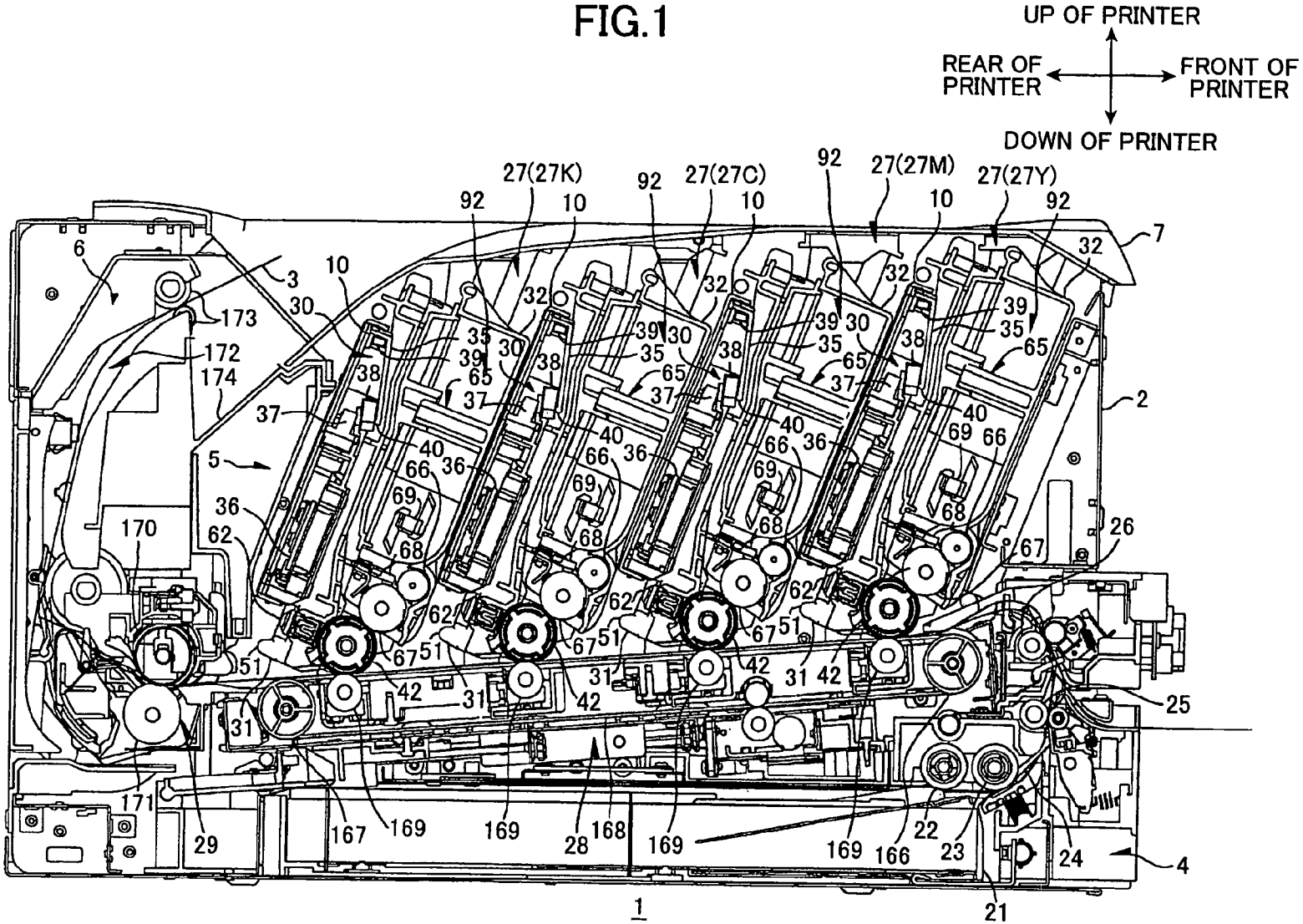
FIG. 1 is a side cross-sectional view showing a color laser printer according to a preferred embodiment of the present invention.

FIG. 1 is a side cross-sectional view showing a color laser printer, serving as a preferred embodiment of the image-forming device according to the present invention.

A color laser printer 1 shown in FIG. 1 is a transverse tandem type color laser printer having a plurality of process sections 27 that are horizontally juxtaposed. The color laser printer 1 includes a main casing 2 and, within the main casing 2, a feeder unit 4 for feeding a paper 3, an image-forming unit 5 for forming images on the paper 3 supplied from the feeder unit 4, and a discharge unit 6 for discharging the paper 3 from the color laser printer 1 after an image has been formed on the paper 3.

The main casing 2 is shaped substantially like an open-topped rectangular box when viewed from the side. A top cover 7 is provided on the top side of the main casing 2. The top cover 7 is rotatably supported by hinges (not shown) disposed on the rear side of the main casing 2 (hereinafter, the left side in FIG. 1 will be referred to as the rear side, while the right side in FIG. 1 will be referred to as the front side) and is capable of opening and closing on the main casing 2.

Figure 17:
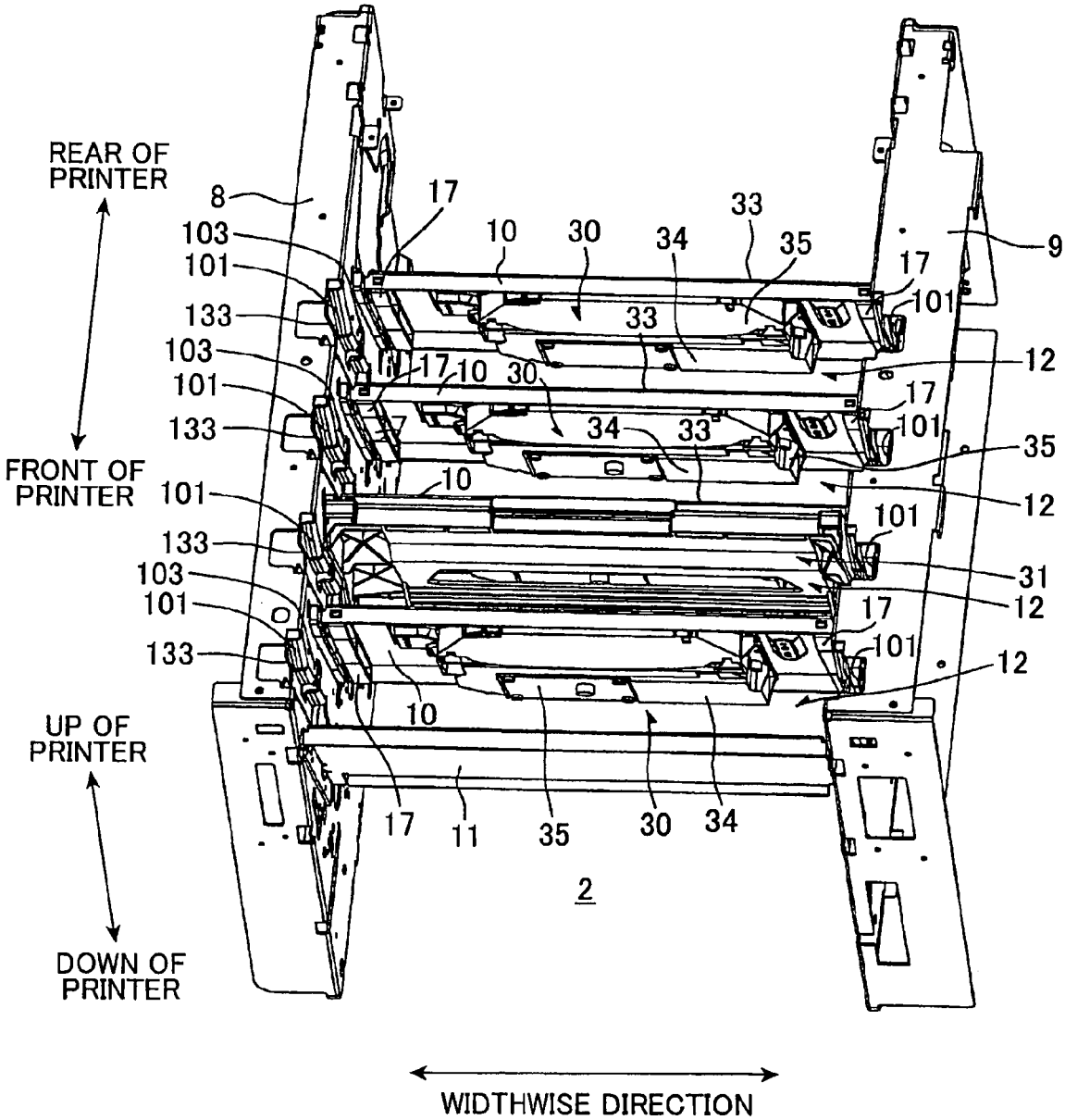
FIG. 17 is a perspective view from above the front side of a main casing in the color laser printer.

As shown in FIG. 17, the main casing 2 includes a left side plate 8 and a right side plate 9 that face each other in a widthwise direction orthogonal to the front-to-rear direction and to the vertical direction and that are separate from each other by a prescribed gap; and four partitioning plates 10 and a front plate 11 that span between the left side plate 8 and right side plate 9. The partitioning plates 10 are disposed in the main casing 2 at prescribed intervals in the front-to-rear direction, and the front plate 11 is disposed further forward of the partitioning plates 10 so as to partition the space between the left side plate 8 and right side plate 9 in the front-to-rear direction into a space for each of the process sections 27 (FIG. 1) described later. Each partition plate 10 has a rear surface 33 on its rear side (FIG. 17).

The partitioning plates 10 and the front plate 11 are each slanted with respect to the front-to-rear direction, which is identical to the direction in which the paper 3 is conveyed through the color laser printer 1 while being formed with images, and the vertical direction, with the top end farther forward than the bottom end. As shown in, the partitioning plates 10 and front plates 11 are arranged so that a vertical gap is formed between the top ends of the plates 10, 11 and the top cover 7 and another vertical gap is formed between the bottom ends of the plates 10, 11 and a transfer section 28 described later.

Accordingly, as shown in FIG. 17, four process-accommodating sections 12 are partitioned in the main casing 2 by the left side plate 8 and right side plate 9 and the adjacent partitioning plates 10 and front plate 11. Each of the process-accommodating sections 12 is provided for one of the process sections 27 corresponding to each printing color. Each of the process-accommodating sections 12 includes a drum-accommodating section 13 for accommodating a drum cartridge 31 described later, and a developer-accommodating section 14 for accommodating a developer cartridge 32 described later. The drum cartridge 31 has a holder unit 43 that is mounted in the drum-accommodating section 13, while the developer cartridge 32 is mounted in the developer-accommodating section 14.

Figure 18:
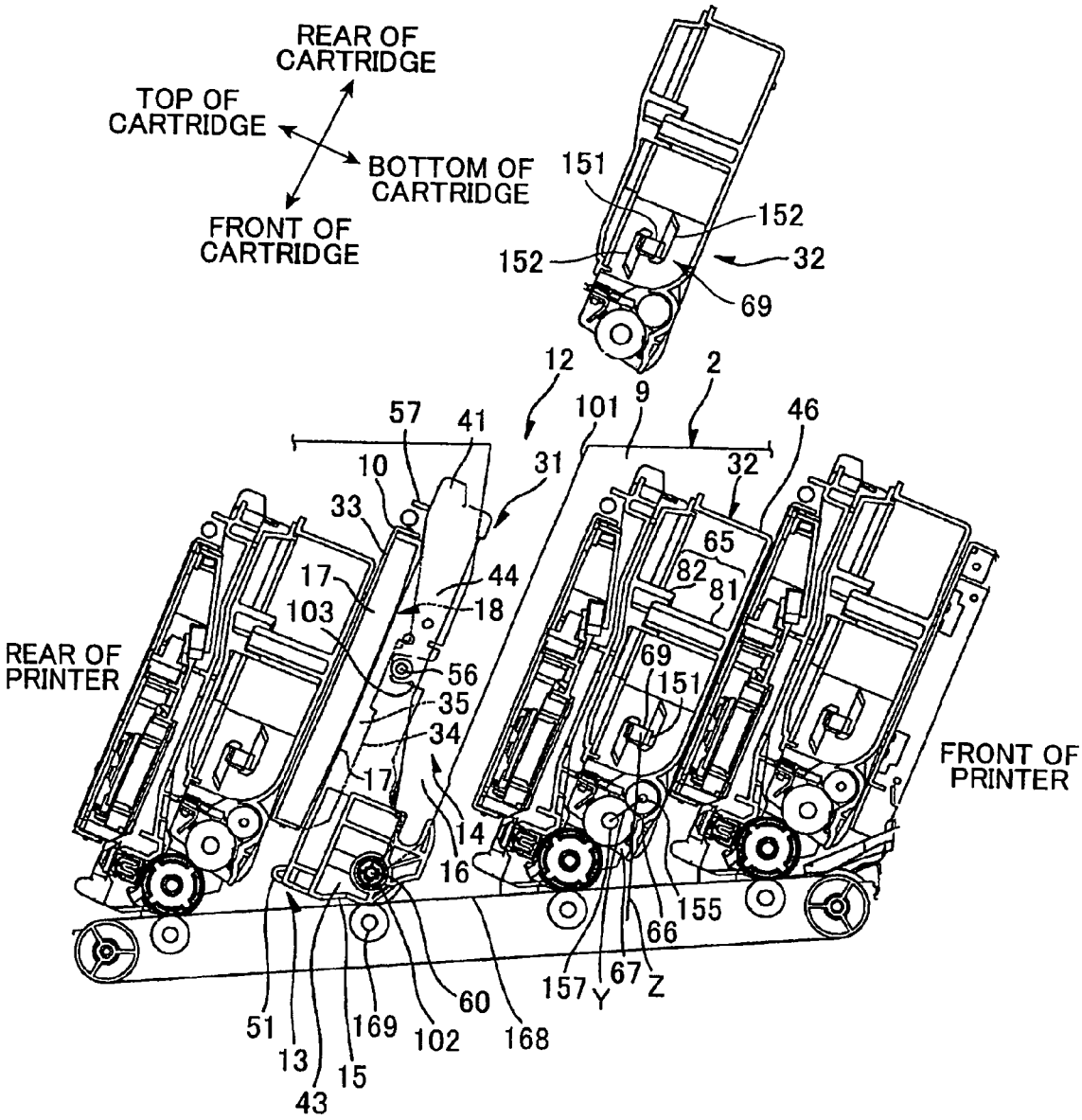
FIG. 18 is a side view illustrating the process of mounting the drum cartridge and developer cartridge in the main casing.

As shown in FIG. 18, the drum-accommodating sections 13 are provided lower than the partitioning plates 10 in spaces partitioned by the left side plate 8 and right side plate 9 in the widthwise direction and by imaginary slanted lines extending from the partitioning plates 10 and the front plate 11 along the same planes thereof in the front-to-rear direction. Each of the spaces partitioned in the drum-accommodating section 13 in this way is a drum-accommodating space 15 for accommodating the holder unit 43 of the drum cartridge 31.

The developer-accommodating section 14 is disposed as a continuation of the drum-accommodating section 13 on the upstream side of the drum-accommodating section 13 with respect to the direction in which the drum cartridge 31 is mounted. In other words, the developer-accommodating section 14 is provided above the drum-accommodating section 13 along the mounting direction for the drum cartridge 31 and the developer cartridge 32. The developer-accommodating sections 14 are partitioned by the partitioning plates 10 and front plate 11 in the front-to-rear direction and by the left side plate 8 and right side plate 9 in the widthwise direction. The internal space of the developer-accommodating sections 14 partitioned in this way (excluding an extended accommodating space 18 described later) forms a developer-accommodating space 16 for accommodating the developer cartridge 32.

As shown in FIGS. 17 and 18, in each of the developer-accommodating sections 14, rail parts 17 are provided on the partitioning plate 10 to extend along both widthwise ends of the partitioning plate 10. The rail parts 17 are formed as thick strips extending in the mounting direction of the drum cartridge 31. When mounting the drum cartridge 31, ridges 51 of the drum cartridges 31 (to be described later) slide against the rail parts 17, respectively.

As shown in FIG. 1, the feeder unit 4 includes: a paper supply tray 21 that is detachably mounted in a lower section of the main casing 2 and can be inserted into or removed from the main casing 2 through the front side in a horizontal direction; a pickup roller 22 and a feeding roller 23 disposed above the front side of the paper supply tray 21; a feeding side U-shaped path 24 disposed in front of and above the feeding roller 23; and a conveying roller 25 and a registration roller 26 disposed along the feeding side U-shaped path 24.

The paper 3 is stacked inside the paper supply tray 21. The pickup roller 22 picks up the topmost sheet of the paper 3 and conveys the sheet forward. Subsequently, the feeding roller 23 feeds the sheet along the feeding side U-shaped path 24. The feeding side U-shaped path 24 is shaped substantially like the letter U and serves as a conveying path for the paper 3. The upstream end of the feeding side U-shaped path 24 is a lower part positioned adjacent to the feeding roller 23 for feeding the paper 3 forward, while the downstream end is an upper part positioned adjacent to a conveying belt 168 described later for conveying the paper 3 rearward.

After the feeding roller 23 feeds the sheet of paper 3 forward along the upstream end of the feeding side U-shaped path 24, the conveying roller 25 continues to convey the paper 3 along the feeding side U-shaped path 24 as the conveying direction of the paper 3 is reversed. The registration roller 26 first registers the sheet of paper 3 and subsequently conveys the sheet rearward.

The image-forming unit 5 includes the process sections 27, the transfer section 28, and a fixing section 29. The process sections 27 are provided one for each color of toner. Specifically, the color laser printer 1 of the preferred embodiment has four process sections 27, including a yellow process section 27Y, a magenta process section 27M, a cyan process section 27C, and a black process section 27K. The process sections 27 are disposed one in each of the process-accommodating sections 12, aligned one after another horizontally and separate from one another by a prescribed gap in the front-to-rear direction.

Each of the process sections 27 includes a scanning unit 30, the drum cartridge 31, and the developer cartridge 32 that is detachably mounted on the drum cartridge 31. A process cartridge is configured of the drum cartridge 31, and the developer cartridge 32 mounted on the drum cartridge 31.

The scanning unit 30 includes a scanner casing 35 and, within the scanner casing 35, a laser light-emitting unit (not shown), a polygon mirror 36, two lenses 37 and 38, and a reflecting mirror 39.

As shown in FIG. 17, the scanner casing 35 is disposed in the widthwise center of each partitioning plate 10 so that the rail parts 17 of each partitioning plate 10 are positioned one on either widthwise end of the scanner casing 35. Further, a rear wall of the scanner casing 35 contacts a front surface of the partitioning plates 10, while a front wall 34 of the scanner casing 35 protrudes forward away from the partitioning plates 10. By disposing the scanner casing 35 so as to protrude forward from the partitioning plates 10 in this way, the scanning unit 30, drum cartridge 31, and developer cartridge 32 can be arranged in close proximity with each other, thereby making it possible to achieve a compact device.

Since the scanner casing 35 protrudes forward from the partitioning plates 10, the drum cartridge 31 is restricted from passing through the developer-accommodating section 14 when the developer cartridge 32 is mounted on the drum cartridge 31. However, the drum cartridge 31 can pass through the developer-accommodating space 16 when the developer cartridge 32 is separated from the drum cartridge 31.

As shown in FIG. 18, due to the scanner casing 35, the developer-accommodating section 14 is formed narrower than the drum-accommodating section 13 in the direction orthogonal to the widthwise direction and the mounting direction of the drum cartridge 31 and developer cartridge 32 (hereinafter, referred to as the "thickness direction" of the drum cartridge 31 and developer cartridge 32).

More specifically, the developer-accommodating section 14 is formed wider in the thickness direction than the thickness of the holder unit 43 of the drum cartridge 31, and narrower than the thickness of the drum cartridge 31 and developer cartridge 32 when mounted on each other.

As shown in FIG. 18, the extended accommodating space 18 is formed in the developer-accommodating section 14 between an upper end and both widthwise ends of the scanner casing 35 and near the front wall 34 of the scanner casing 35 (a space between the front wall 34 of the scanner casing 35 and the developer-accommodating space 16 in which a middle plate 54 described later is provided). The extended accommodating space 18 accommodates an extended part 44 of the drum cartridge 31 described later.

As shown in FIG. 1, a window 40 is formed in the front wall 34 of the scanner casing 35 for allowing the passage of a laser beam. The laser light-emitting unit of the scanning unit 30 emits a laser beam based on prescribed image data. This laser beam is deflected by the polygon mirror 36, passes through or is reflected by the lens 37, reflecting mirror 39, and lens 38, and is irradiated through the window 40.

Figure 2:
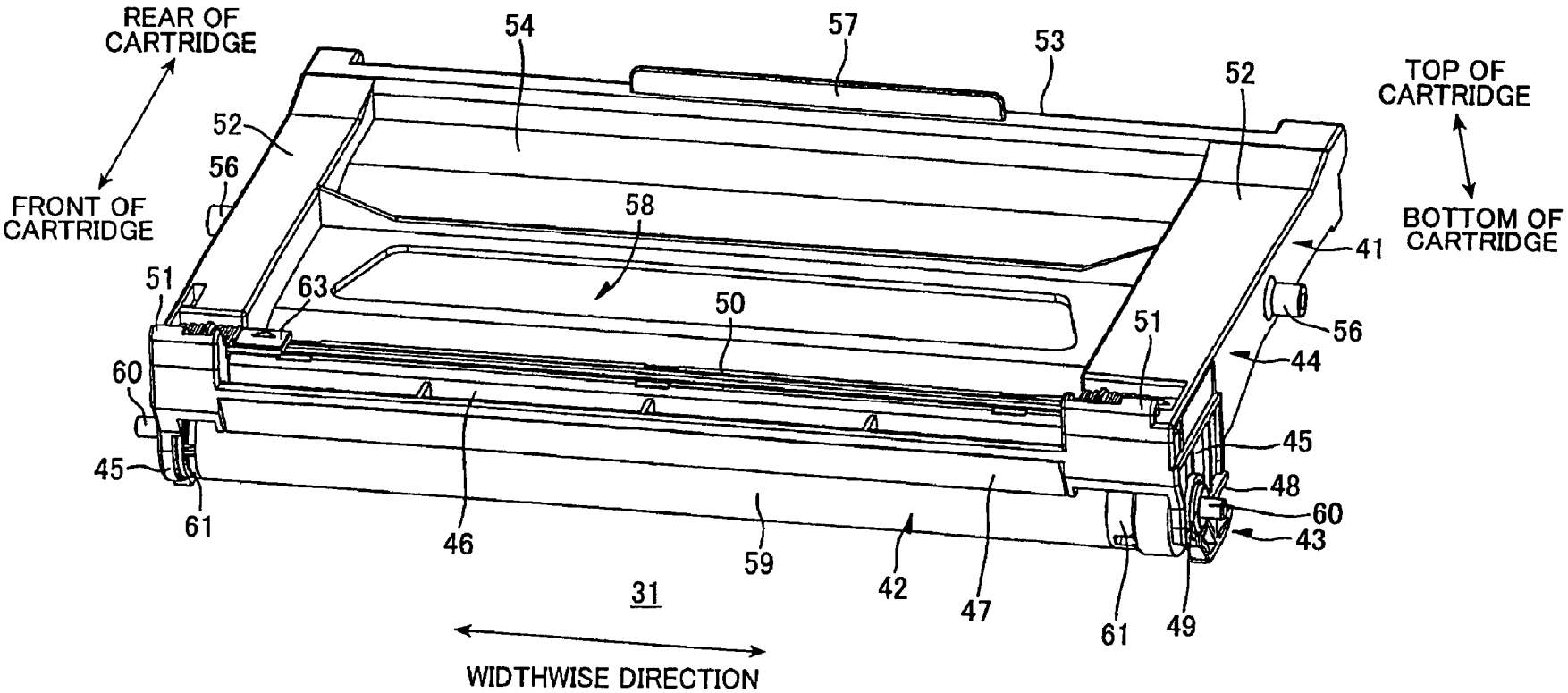
FIG. 2 is a perspective view from the top front side of a drum cartridge for the color laser printer of FIG. 1.
Figure 3:
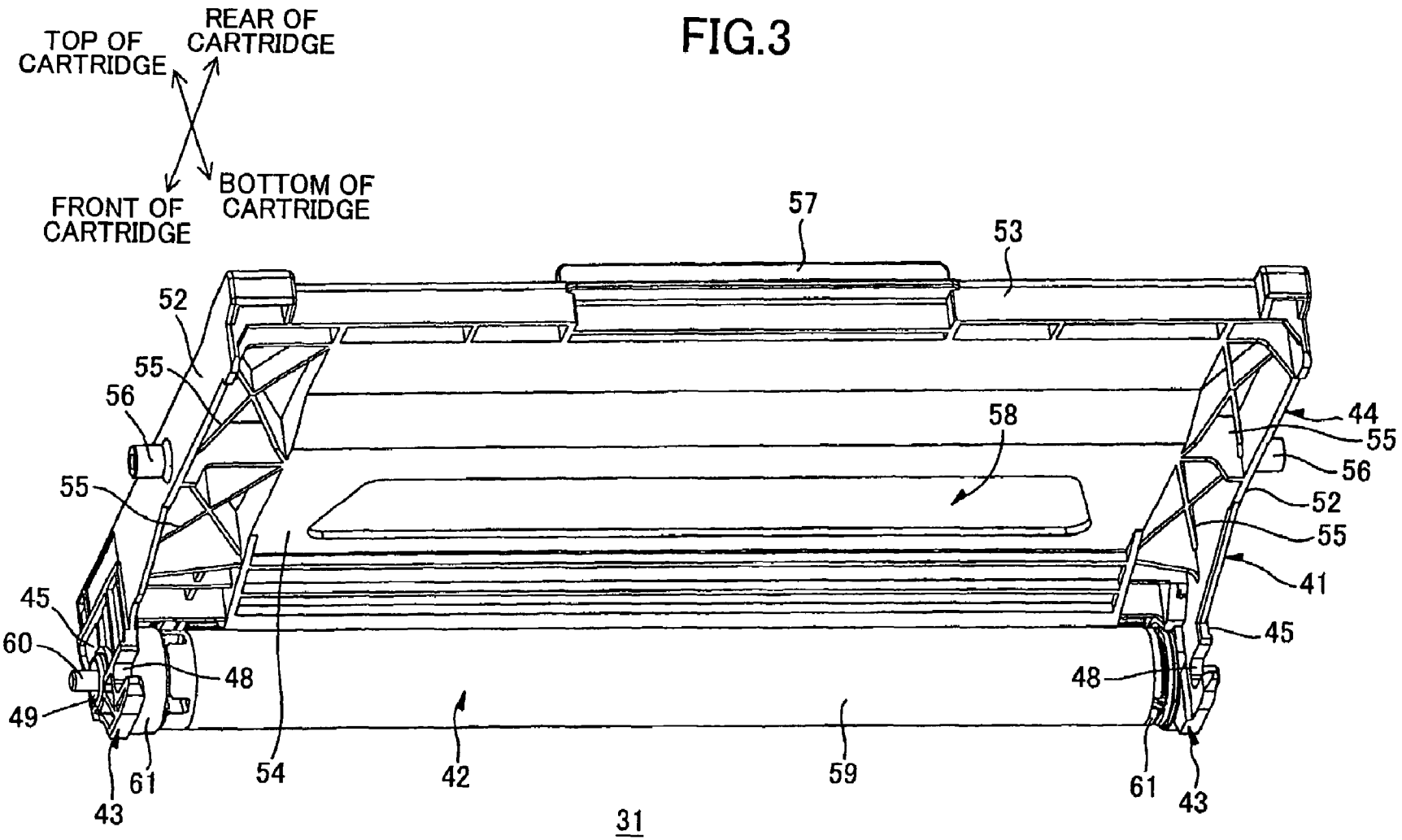
FIG. 3 is a perspective view from the bottom rear side of the drum cartridge.

As shown in FIGS. 2 and 3, the drum cartridge 31 includes a drum casing 41; and a photosensitive drum 42 and a Scorotron charger 62 (see FIG. 1) disposed in the drum casing 41.

The drum casing 41 includes the holder unit 43, and the extended part 44 extending from the holder unit 43. The holder unit 43 and extended part 44 are integrally formed of a synthetic resin.

Below, the drum cartridge 31 will be described with reference to FIGS. 2 through 7. In the following description, when the drum cartridge 31 is in a mounted state in the color laser printer 1, the side of the drum cartridge 31 in the thickness direction positioned toward the rear side of the color laser printer 1 will be referred to as the top surface side or upper side of the drum cartridge 31; the side positioned toward the front of the color laser printer 1 will be referred to as the bottom surface side or lower side of the drum cartridge 31; the side of the drum cartridge 31 downstream in the mounting direction will be referred to as the front side of the drum cartridge 31; and the side of the drum cartridge 31 upstream in the mounting direction will be referred to as the rear side of the drum cartridge 31. The widthwise direction of the drum cartridge 31 is defined as perpendicular to both of the top-to-bottom direction and the front-to-rear direction of the drum cartridge 31.

The holder unit 43 includes two side walls 45 opposing each other across a prescribed gap in the widthwise direction, a top wall 46 that spans between the upper edges of the side walls 45, and a front wall 47 that extends from the front edge of the top wall 46 vertically along part of the front edges of the side walls 45. The holder unit 43 is thicker than a developer casing 64 of the developer cartridge 32.

The holder unit 43 is formed thicker than the extended part 44. This construction can reliably accommodate the photosensitive drum 42 and the charger 62.

Figure 6:
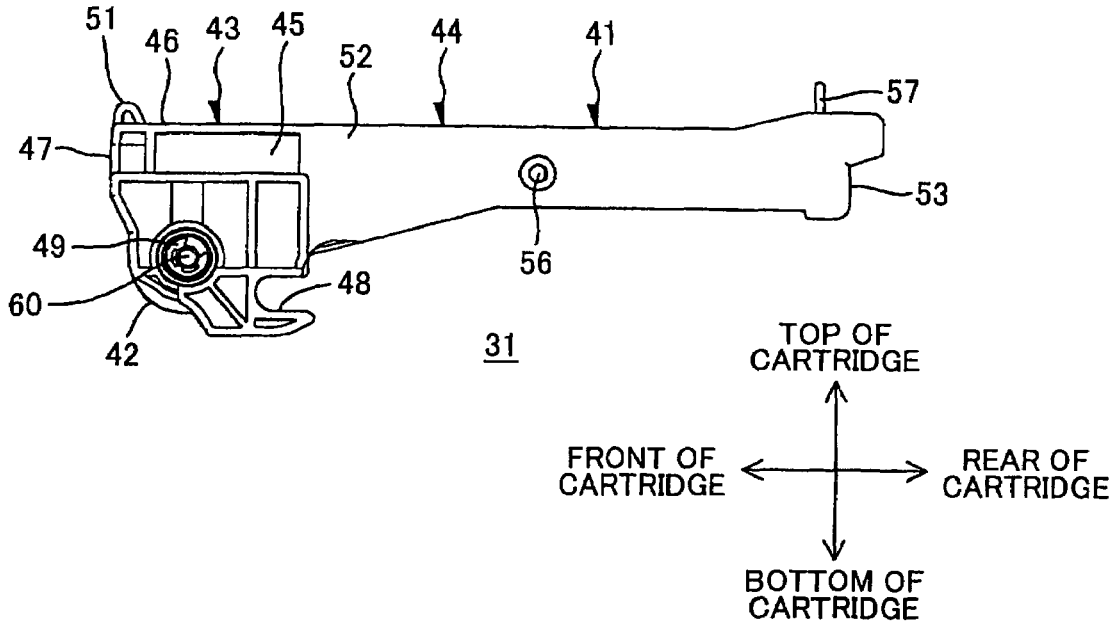
FIG. 6 is a right side view of the drum cartridge.
Figure 7:
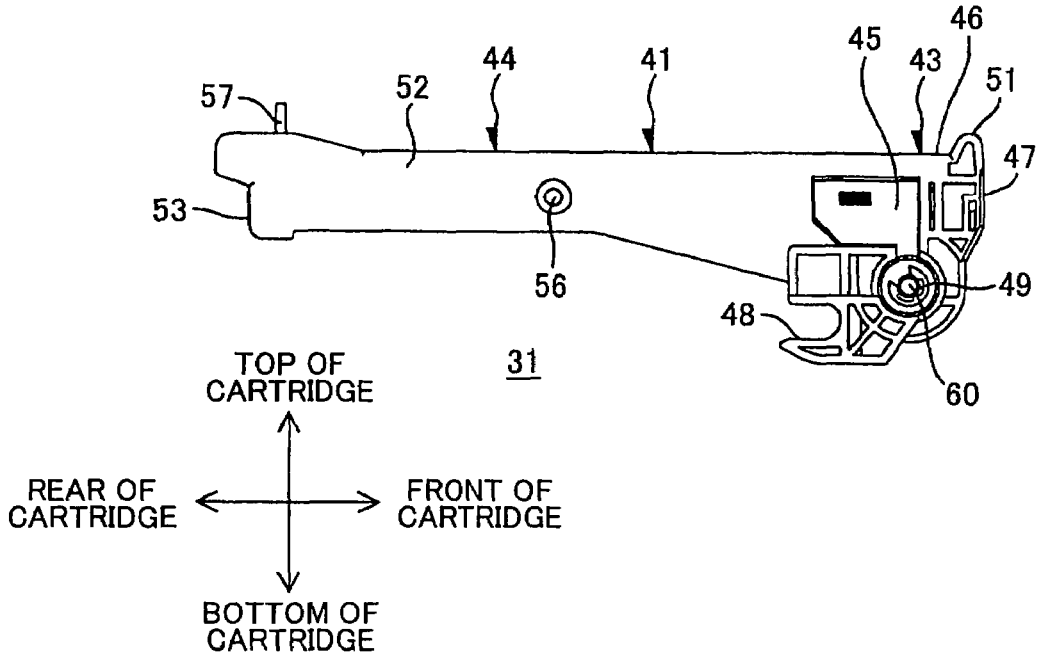
FIG. 7 is a left side view of the drum cartridge.

As shown in FIGS. 6 and 7, a developer positioning groove 48 formed substantially in the shape of a U that opens rearward is formed on the lower part of each side wall 45. An insertion part 49 is formed on the front side of the developer positioning groove 48 for inserting a drum shaft 60 of the photosensitive drum 42.

As shown in FIG. 2, a cleaner fitting part 50 is formed in the top wall 46 along the width of the same. A cleaner 63 described later is slidably fitted into the cleaner fitting part 50. As shown in FIGS. 6 and 7, the ridges 51 formed on both widthwise ends of the top wall 46 are substantially triangular shaped protrusions when viewed from the side that protrude upward on the front end of the top wall 46.

As shown in FIGS. 2 and 3, the extended part 44 extends rearward from the holder unit 43 so as to extend above the upper end of the scanner casing 35 in the developer-accommodating section 14 when the holder unit 43 is mounted in the drum-accommodating section 13.

The extended part 44 includes two extended side parts 52 that face each other across a gap in the widthwise direction, an extended rear wall 53 that spans between the rear edges of the extended side parts 52, and the middle plate 54 disposed in an area surrounded by the holder unit 43, the extended side parts 52, and the extended rear wall 53.

As shown in FIG. 2, each of the extended side parts 52 has a substantially box-shaped cross section that is open on the bottom. As shown in FIG. 2, the outside surfaces of the extended side parts 52 extend rearward from both widthwise ends of the holder unit 43 so as to extend continuously rearward from the top of the developer positioning grooves 48.

As shown in FIG. 3, two reinforcing ribs 55 substantially X-shaped from a bottom view are disposed in the box-shaped interior of the extended side parts 52 along the front-to-rear direction. A drum boss 56 protruding outward in the widthwise direction is provided on the outer side surface of each extended side part 52 midway along the longitudinal direction thereof.

As described above, the extended rear wall 53 extends in the widthwise direction, connecting the rear edges of the extended side parts 52. A drum grip 57 is provided in the widthwise center of the extended rear wall 53 to facilitate gripping the drum cartridge 31 and mounting and removing the drum cartridge 31 with respect to the drum-accommodating section 13.

Figure 4:
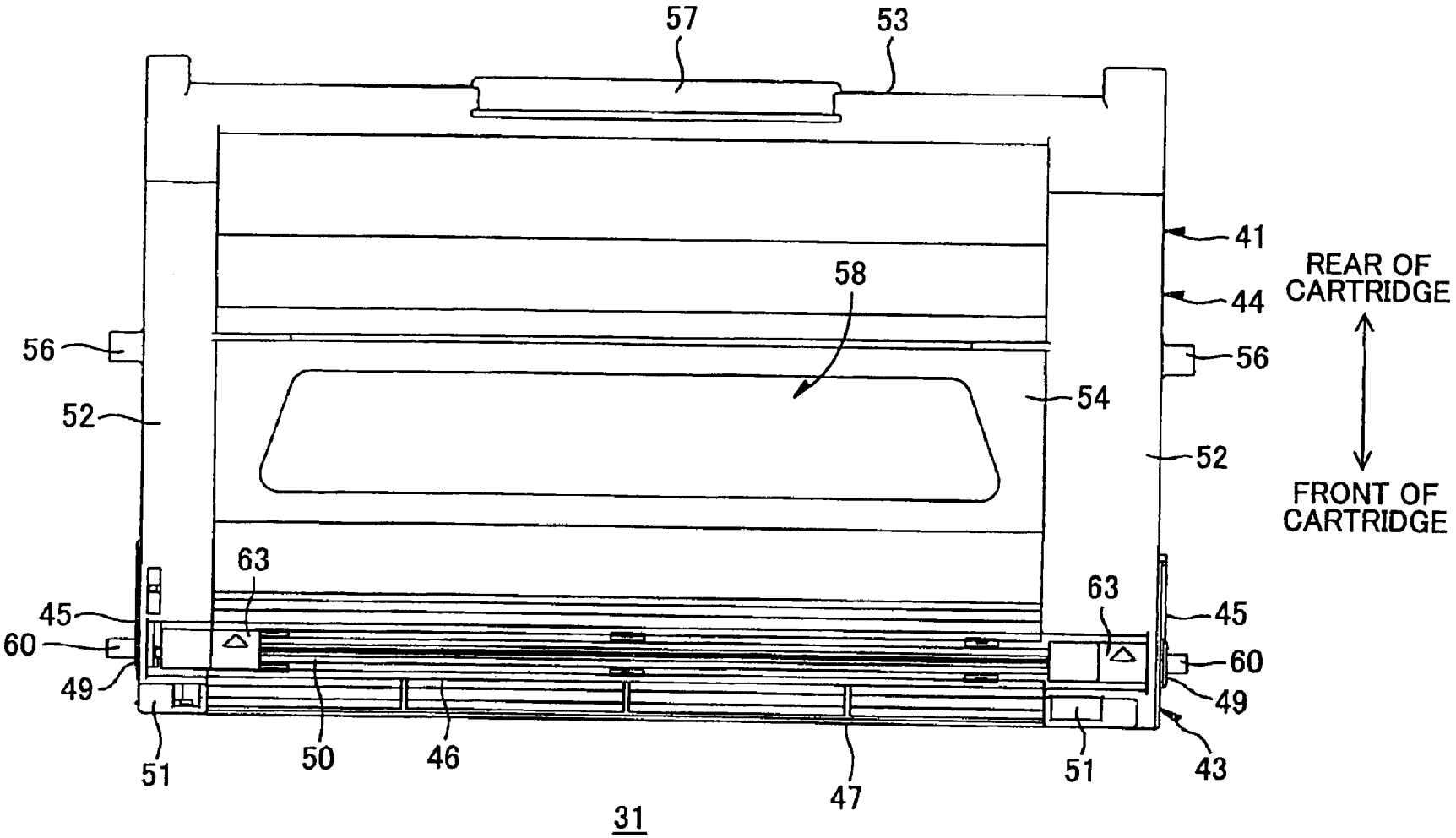
FIG. 4 is a plan view of the drum cartridge.

The middle plate 54 is formed in a substantially rectangular planar shape as shown in FIG. 2. The middle plate 54 is disposed in a portion surrounded by the holder unit 43, extended side parts 52, and extended rear wall 53 and is connected to the holder unit 43, extended side parts 52, and extended rear wall 53 at a position sunken below the top surface of the extended side parts 52 and extended rear wall 53. An opening 58 is formed in the middle plate 54 to allow passage of a laser beam emitted through the window 40 of the scanner casing 35. As shown in FIG. 4, the opening 58 is shaped like a trapezoid in a plan view with the front side wider than the rear side. By forming the opening 58 to be trapezoidal in a plan view, it is possible to cut out only the portion of the middle plate 54 through which the laser beam passes, resulting in a stronger extended part 44 than when the middle plate 54 is formed to be rectangular in a plan view.

As shown in FIG. 2, the photosensitive drum 42 is accommodated within the holder unit 43 along the widthwise direction. The photosensitive drum 42 includes a main drum body 59 that is cylindrical in shape and has a positive charging photosensitive layer formed of a polycarbonate or the like on its outer surface, and the drum shaft 60 extending along the axial center of the main drum body 59. The drum shaft 60 is supported by both axial ends in the side walls 45 such that each axial end is inserted into the insertion part 49 of the respective side wall 45 and protrudes axially outward from each side wall 45. The drum shaft 60 is incapable of rotating relative to the side walls 45.

Figure 5:
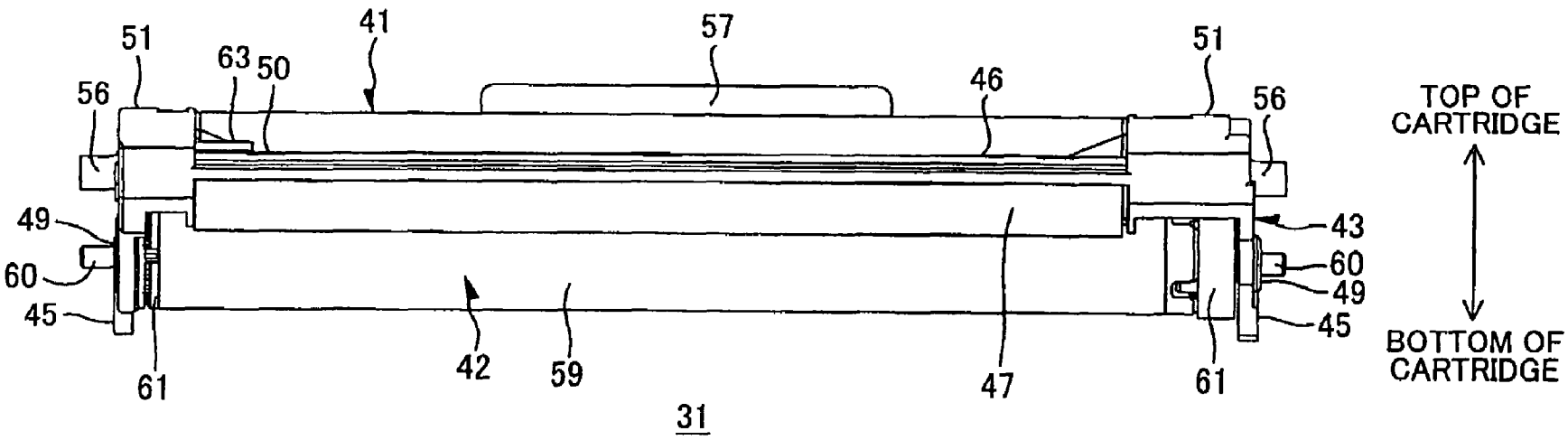
FIG. 5 is a front view of the drum cartridge.

A rotational support member 61 is fitted onto each axial end of the main drum body 59 so as to be incapable of rotating relative to the main drum body 59. The rotational support members 61 are supported on and capable of rotating relative to the drum shaft 60. Hence, the main drum body 59 is supported so as to be capable of rotating relative to the drum shaft 60. With this construction, as shown in FIG. 5, the photosensitive drum 42 is disposed in the holder unit 43 so that a front surface is exposed below the front wall 47.

As shown in FIG. 1, the charger 62 is accommodated in the holder unit 43 above the ridges 51 (rearward in FIG. 2) and extends in the widthwise direction. The charger 62 is a positive-charging Scorotron charger that includes a wire and a grid for generating a corona discharge. The charger 62 is supported on the top wall 46 rearward of the photosensitive drum 42 (above in FIG. 2) and faces the photosensitive drum 42 at a prescribed distance so as not to contact the same. As shown in FIG. 2, the charger 62 is provided with the cleaner 63 for cleaning the wire. The cleaner 63 is slidably fitted into the cleaner fitting part 50 of the top wall 46.

Figure 8:
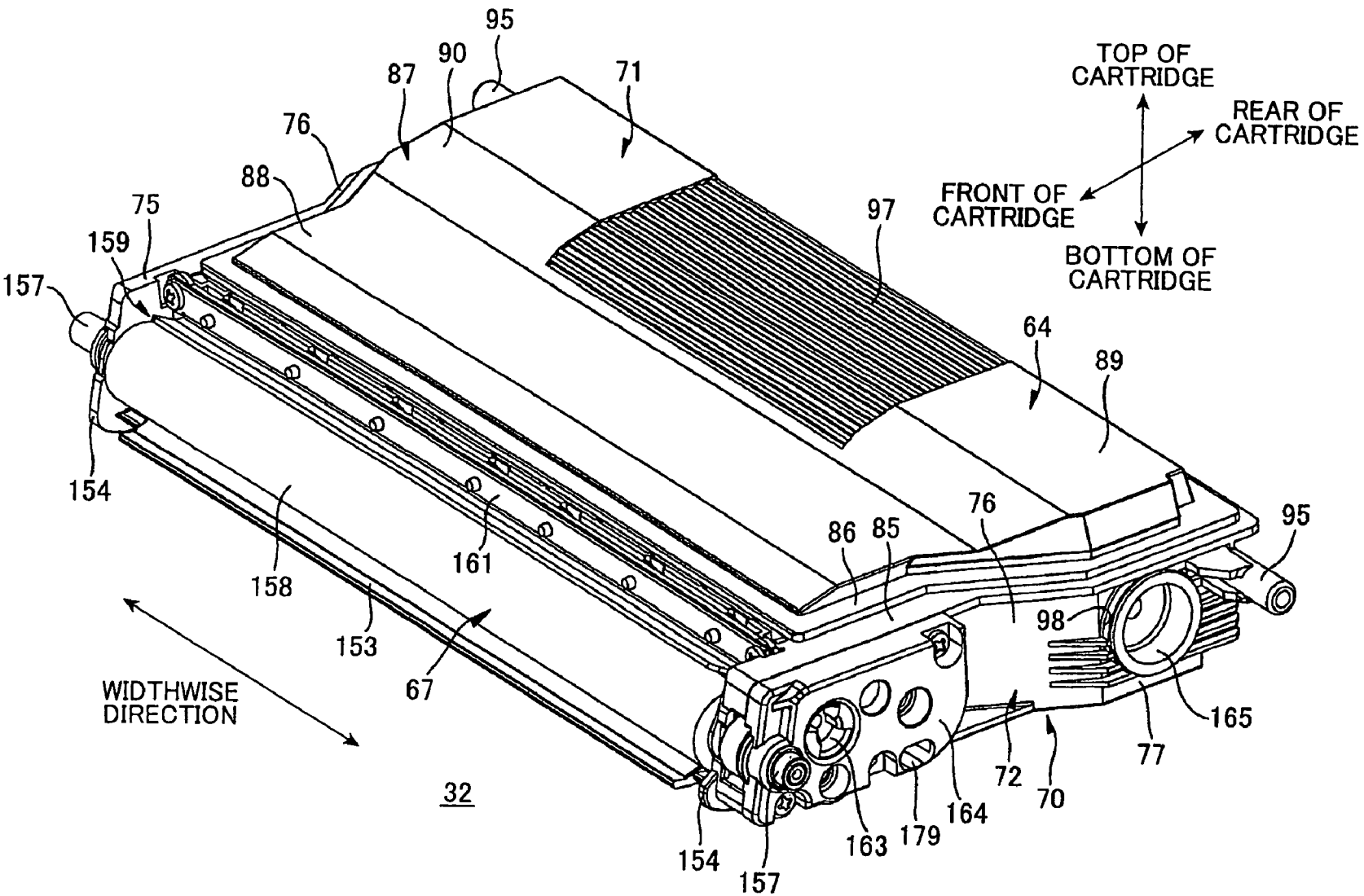
FIG. 8 is a perspective view from the top front side of a developer cartridge for the color laser printer of FIG. 1.
Figure 16:
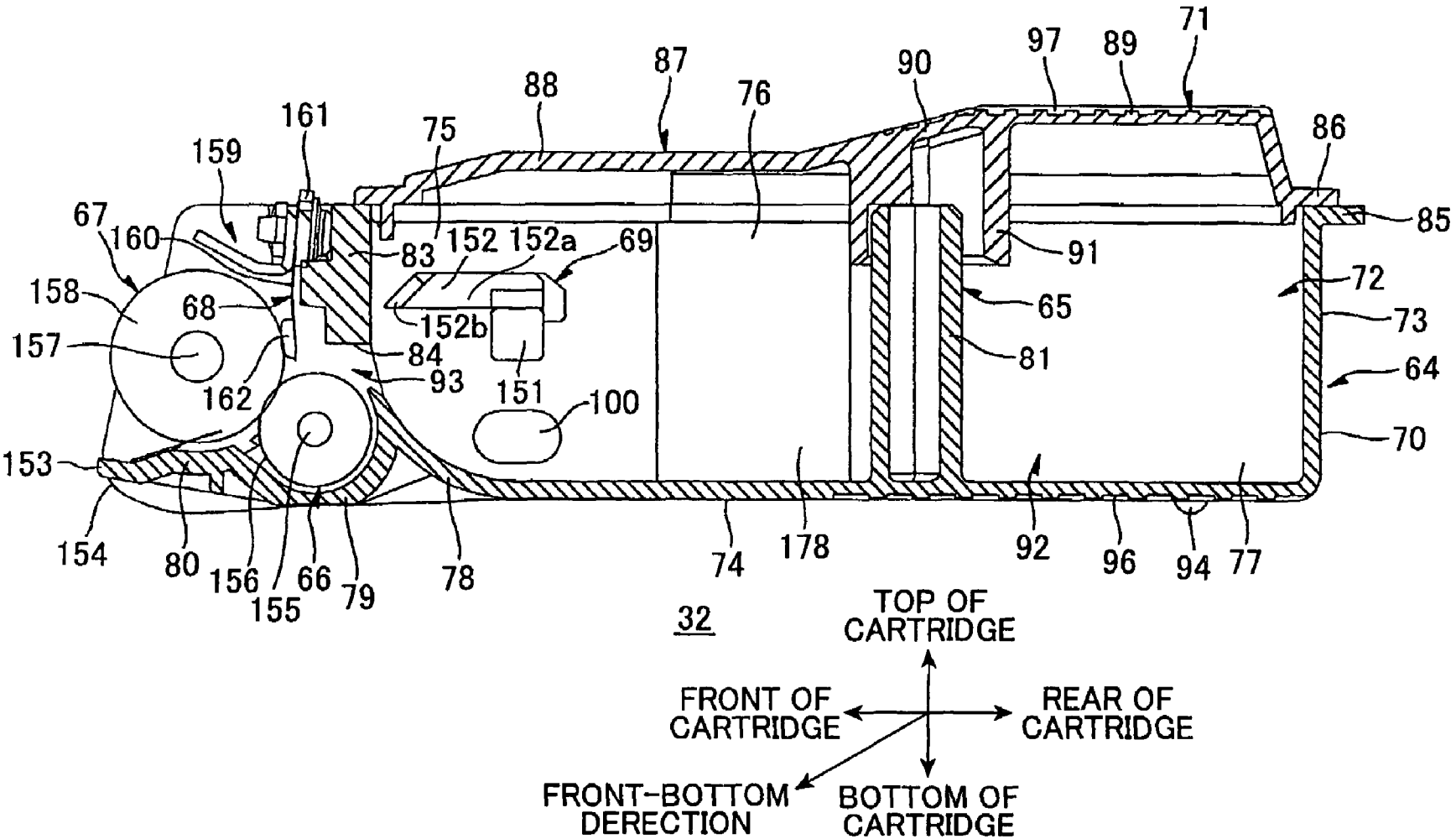
FIG. 16 is a side cross-sectional view of the developer cartridge.

The developer cartridge 32 shown in FIGS. 1, 8 and 16 includes the developer casing 64, and, provided in the developer casing 64, an agitator 69, a supply roller 66, a developing roller 67, and a thickness-regulating blade 68.

Next, the developer cartridge 32 will be described in detail with reference to FIGS. 8 through 16.

In the following description, when the developer cartridge 32 is in a mounted state in the color laser printer 1, the side of the developer cartridge 32 in the thickness direction positioned toward the rear side of the color laser printer 1 will be referred to as the top surface side or upper side of the developer cartridge 32; the side positioned toward the front of the color laser printer 1 will be referred to as the bottom surface side or lower side of the developer cartridge 32; the side of the developer cartridge 32 downstream in the mounting direction will be referred to as the front side of the developer cartridge 32; and the side of the developer cartridge 32 upstream in the mounting direction will be referred to as the rear side of the developer cartridge 32. The widthwise direction of the developer cartridge 32 is defined as perpendicular to both of the top-to-bottom direction and the front-to-rear direction of the developer cartridge 32.

Figure 15:
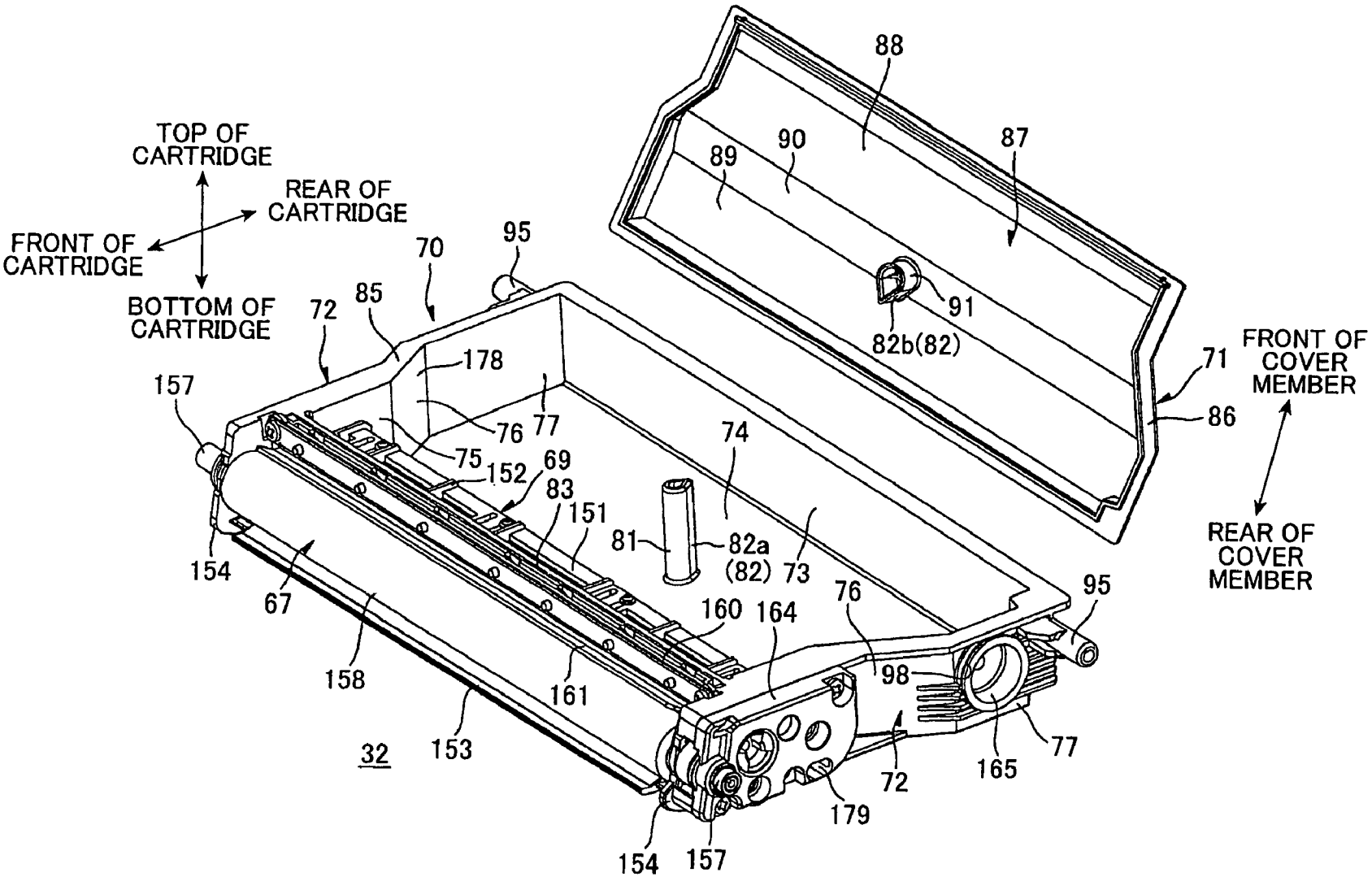
FIG. 15 is an exploded perspective view of the developer cartridge.

As shown in FIG. 8, the developer casing 64 is formed in a thin box shape with an open front side. As shown in FIG. 15, the developer casing 64 includes a casing member 70 that is open on the top surface side; and a cover member 71 formed separately from the casing member 70 for covering the open top surface side of the casing member 70.

The casing member 70 includes a pair of side walls 72 spaced apart from each other and facing each other in the widthwise direction; a rear wall 73 connected to the rear edges of the side walls 72; and a bottom wall 74 connected to the bottom edges of the side walls 72 and rear wall 73 so as to cover one side of an area surrounded by the side walls 72 and rear wall 73.

Figure 14:
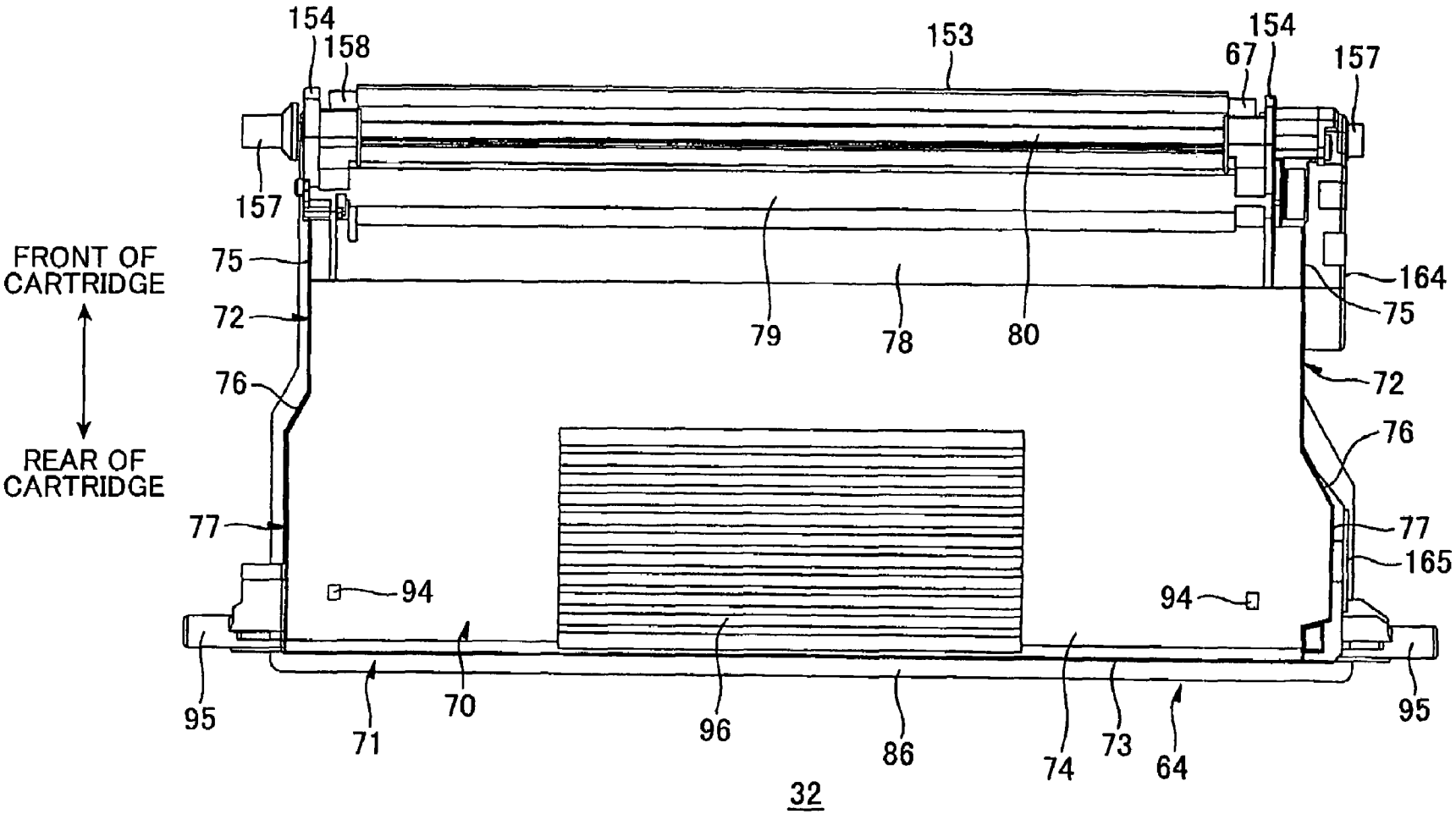
FIG. 14 is a bottom view of the developer cartridge.

As shown in FIG. 14, each of the side walls 72 has a plate shape and extends in the front-to-rear direction. Each side wall 72 is integrally provided with a front side wall 75, a sloped wall 76, and a rear side wall 77 that are connected seamlessly in the front-to-rear direction.

These front side walls 75 are provided parallel to each other on opposing sides of the thickness-regulating blade 68, supply roller 66, and agitator 69 and are disposed on the front of the developer cartridge 32 extending from the front edge rearward to corresponding midway positions in the front-to-rear direction.

The rear side walls 77 are also disposed parallel to each other in the rear of the developer cartridge 32 on the opposite side of the agitator 69 from the developing roller 67 and extend from the rear edge of the developer cartridge 32 forward to corresponding midway positions in the front-to-rear direction so that a gap is formed between the front end of the rear side walls 77 and the rear end of the front side walls 75 in the front-to-rear direction. The rear side walls 77 are separate from each other by a distance greater than the distance separating the front side walls 75.

The sloped walls 76 are provided at a slant to the front-to-rear direction so that the distance between the two grows gradually larger from the front edges toward the rear edges. The sloped walls 76 are disposed between the front side walls 75 and rear side walls 77 so that the front edges of the sloped walls 76 are connected to the front side walls 75, while the rear edges are connected to the rear side walls 77. As shown in FIG. 15, the inner surface of the sloped walls 76 is a sloped wall 178 for guiding discharged toner, as described later.

Figure 9:
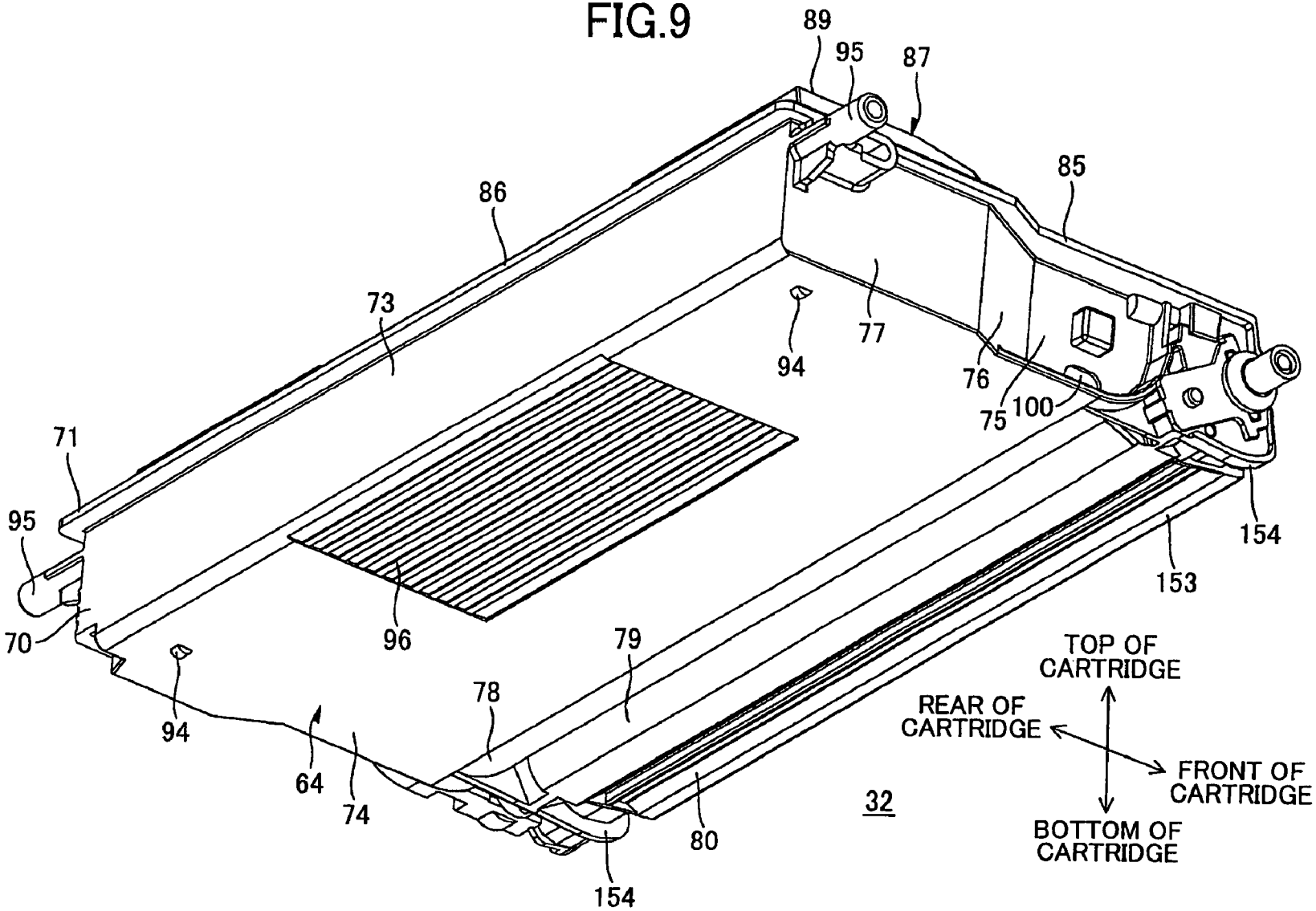
FIG. 9 is a perspective view from the bottom rear side of the developer cartridge.
Figure 10:
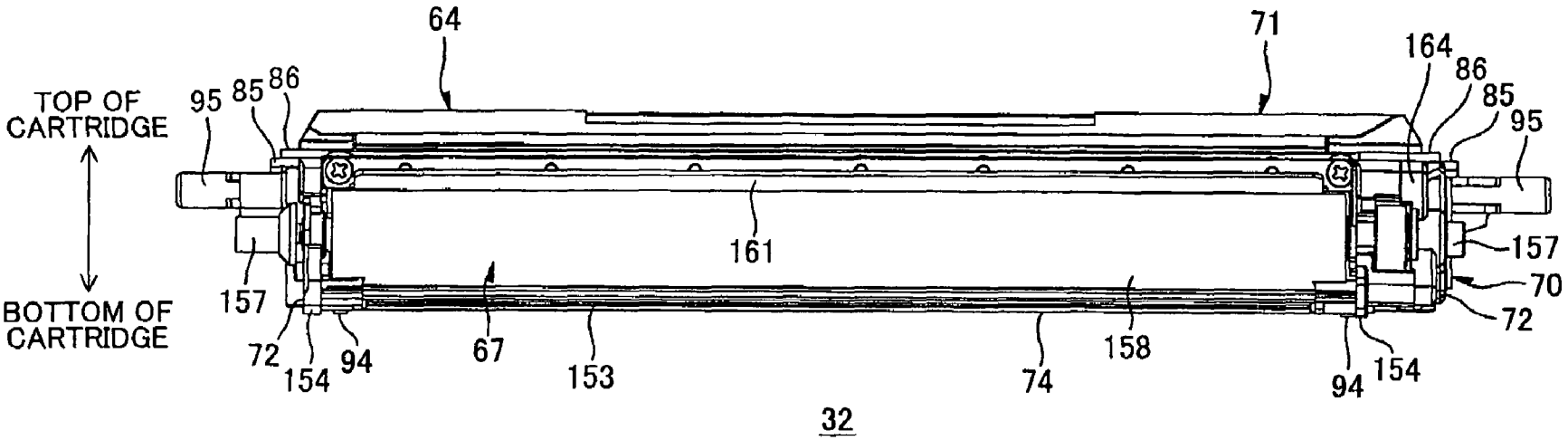
FIG. 10 is a front view of the developer cartridge.

As shown in FIG. 9, developer bosses 95 protrude outward in the widthwise direction from the rear ends of the rear side walls 77 near the top surface side.

As shown in FIGS. 9 and 15, the rear wall 73 is formed in the shape of a thin rectangular plate extending in the widthwise direction.

As shown in FIG. 16, the bottom wall 74 is plate-shaped. The front end of the bottom wall 74 (the portion between the front side walls 75 downstream in the mounting direction of the developer cartridge 32) is formed sequentially of a discharge wall 78, a supply roller accommodating wall 79, and a tongue wall 80 from the rear side toward the front side. The discharge wall 78 protrudes toward the top surface side and has an arc-shaped cross-section that follows the rotating path of the agitator 69. The supply roller accommodating wall 79 has an arc-shaped cross-section following the outer periphery of the supply roller 66. The tongue wall 80 slants downward toward the front to expose the developing roller 67.

As shown in FIG. 14, a bottom grip part 96 is provided on the outer surface of the bottom wall 74 to provide the user with a grip region. The bottom grip part 96 is disposed on the bottom wall 74 in the widthwise center thereof and extends from the rear of the bottom wall 74 (the portion of the bottom wall 74 between the rear side walls 77 on the upstream side in the mounting direction of the developer cartridge 32) to a midway position between the front and rear ends of the bottom wall 74 (the portion of the bottom wall 74 between the sloped walls 76 on the midway in the mounting direction of the developer cartridge 32). The bottom grip part 96 is substantially rectangular in a bottom view and has an irregular or corrugated surface for gripping. The bottom grip part 96 serves as a mark to indicate that the user should grip the developer cartridge 32 there.

As shown in FIG. 9, contact protrusions 94 are formed on the outer surface of the bottom wall 74 near the rear side on both widthwise ends and protrude slightly outward from the bottom surface.

As shown in FIG. 15, a support post member 81 is erected upward from the inner surface of the bottom wall 74 at a position in the widthwise center and between the front and rear ends of the bottom wall 74.

The support post member 81 is disposed on the inner surface of the bottom wall 74 opposite the bottom grip part 96 provided on the outer surface of the bottom wall 74. As shown in FIG. 16, the support post member 81 is erected to a height substantially equivalent to the height of the rear wall 73 in the thickness direction of the developer cartridge 32. As shown in FIG. 15, the support post member 81 is disposed in the widthwise center and the front-to-rear center of a toner-accommodating chamber 92 described later so as to be separate from each of the side walls 72, rear wall 73, and a partitioning wall 83 described later. The support post member 81 is substantially cylindrical in shape and has a teardrop-shaped cross-section, with the tapered point of the teardrop shape pointing rearward and the rounded bottom end of the teardrop pointing forward. The substantially V-shaped tapered surface formed along the rear side of the support post member 81 serves as a guide surface 82*a* for guiding toner in a discharging direction (downward when the developer cartridge 32 is mounted).

As shown in FIG. 16, the partitioning wall 83 spans between the front side walls 75 at a midpoint in the front-to-rear direction of the front side walls 75. The partitioning wall 83 has a thin rectangular shape extending in the widthwise direction and extends from the top surface side edges of the front side walls 75 part way toward the bottom surface side in the thickness direction of the developer cartridge 32. A gap is formed in the thickness direction between the edge of the partitioning wall 83 facing the bottom surface side and a connection part between the front edge of the discharge wall 78 and the rear edge of the supply roller accommodating wall 79 that protrude toward the top surface side. The partitioning wall 83 closes a top surface side of a discharge opening 84 which is described later, along the widthwise direction of the developer cartridge 32, that is, the longitudinal direction of the discharge opening 84.

The long, narrow discharge opening 84 extending in the widthwise direction of the developer cartridge 32 is formed between the end of the partitioning wall 83 facing the lower surface side and the connection part between the front end of the discharge wall 78 and the rear end of the supply roller accommodating wall 79.

As shown in FIG. 15, a rim part 85 for contacting the peripheral edge of the cover member 71 is formed along edge parts on the top surface sides of the side walls 72, the partitioning wall 83, and the rear wall 73.

The cover member 71 is formed in a substantial plate shape that corresponds to the space surrounded by the partitioning wall 83, side walls 72, and rear wall 73. The cover member 71 is integrally formed of a contact part 86 formed along the peripheral edge of the cover member 71 in the same plane for contacting the rim part 85 of the casing member 70; and a top wall 87 that is enclosed by the contact part 86 and depressed toward the top surface side.

The top wall 87 is integrally provided with a front top wall 88 that is shaped like a rectangular plate and is disposed on the front side of the cover member 71; a rear top wall 89 that is shaped like a rectangular plate provided on the rear side of the cover member 71 and that is wider and more deeply depressed than the front top wall 88; and a center top wall 90 having a substantial trapezoidal plate shape that is provided between the front top wall 88 and rear top wall 89 in the front-to-rear direction.

As shown in FIG. 8, a top side grip part 97 is provided on the outer surface of the top wall 87 as a region for the user to grip. The top side grip part 97 is disposed in the widthwise center region of the top wall 87 from the rear top wall 89 to the center top wall 90. The top side grip part 97 is substantially rectangular in a plan view and has an irregular or corrugated surface. The top side grip part 97 serves as a mark that directs the user where to grip the developer cartridge 32.

As shown in FIG. 15, a cylindrical fitting part 91 is disposed on the inner surface of the top wall 87 in the widthwise center of the center top wall 90 for fitting over the end of the support post member 81 on the top surface side. The cylindrical fitting part 91 is provided on the inner surface of the top wall 87 at a position corresponding to the top side grip part 97 provided on the outer surface of the top wall 87. As shown in FIG. 16, the cylindrical fitting part 91 extends toward the bottom wall 74 from the center top wall 90 farther than the depth of the depression in the rear top wall 89 from the contact part 86. The cylindrical fitting part 91 is substantially cylindrical in shape and has a substantially teardrop-shaped cross-section resembling the cross-section of the support post member 81, but slightly larger so as to fit over the support post member 81. A guide surface 82*b* formed on the cylindrical fitting part 91 corresponds to the guide surface 82*a* formed on the support post member 81.

The developer casing 64 is formed by covering the casing member 70 with the cover member 71 so that the contact part 86 of the cover member 71 contacts the rim part 85 of the casing member 70 and the top end of the support post member 81 fits inside the cylindrical fitting part 91 and subsequently welding the contact part 86 to the rim part 85. The developer casing 64 is formed in a thin structure with the bottom grip part 96 and top side grip part 97 opposing each other in the thickness direction, enabling the user to grip and hold the bottom grip part 96 and top side grip part 97 in one hand.

When the support post member 81 is fitted into the cylindrical fitting part 91, the support post member 81 and cylindrical fitting part 91 form the reinforcing post 65 that spans between the bottom wall 74 and the top wall 87, as shown in FIG. 16.

In the developer casing 64 having the construction described above, the toner-accommodating chamber 92 is defined by the top wall 87; the rear-to-middle section of the bottom wall 74 having the discharge wall 78 and opposing the top wall 87 at prescribed distances in the thickness direction; and the side walls 72 (specifically, from the rear side walls 77 to a midpoint of the front side walls 75 in the front-to-rear direction), the rear wall 73, and the partitioning wall 83 provided between the top wall 87 and the bottom wall 74.

A developing chamber 93 is formed further forward from the toner-accommodating chamber 92 by the front section of the bottom wall 74 including the supply roller accommodating wall 79 and the tongue wall 80, the side walls 72 formed continuously with the front side of the bottom wall 74 (specifically, from the front edge to a midpoint of the front side walls 75 in the front-to-rear direction), and the partitioning wall 83.

In the toner-accommodating chamber 92, the front top wall 88 and rear top wall 89 are disposed parallel to the bottom wall 74 such that the distance between the rear top wall 89 and the bottom wall 74 is greater than the distance between the front top wall 88 and the bottom wall 74. The center top wall 90 is disposed at a slant to the bottom wall 74, sloping toward the top surface side from the front to the rear.

Figure 11:
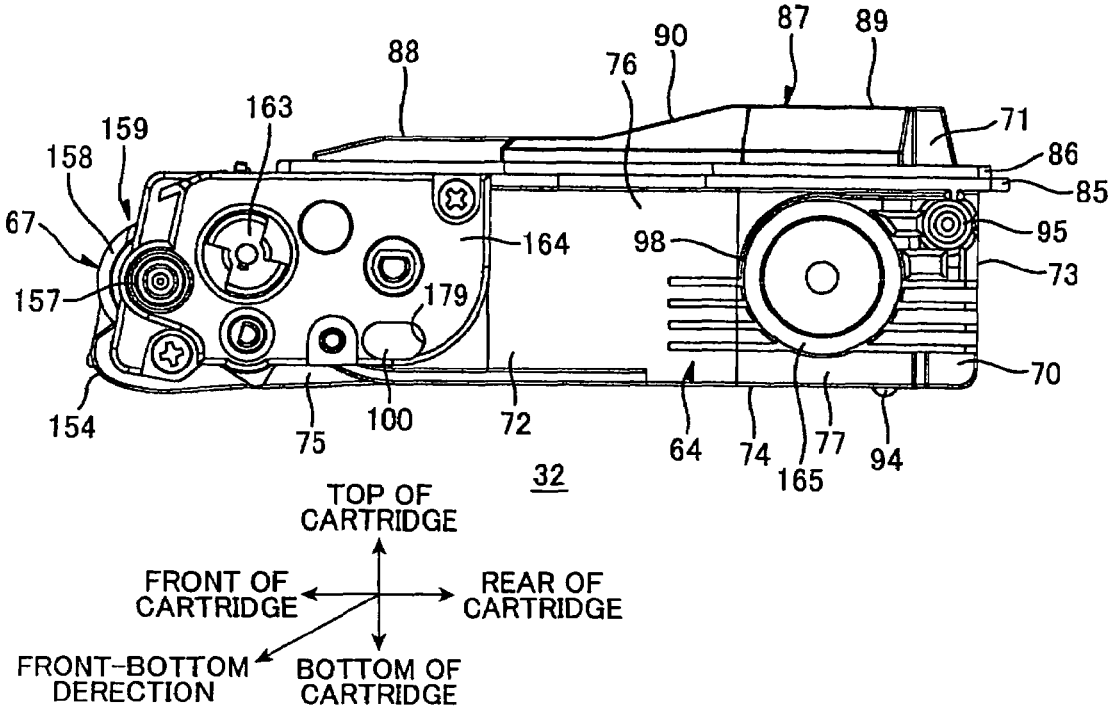
FIG. 11 is a right side view of the developer cartridge.

A toner fill through-hole 98 is formed in one of the rear side walls 77 of the toner-accommodating chamber 92. As shown in FIG. 11, the toner fill through-hole 98 is substantially circular in a side view and penetrates the rear side wall 77 in the thickness direction.

Figure 19:
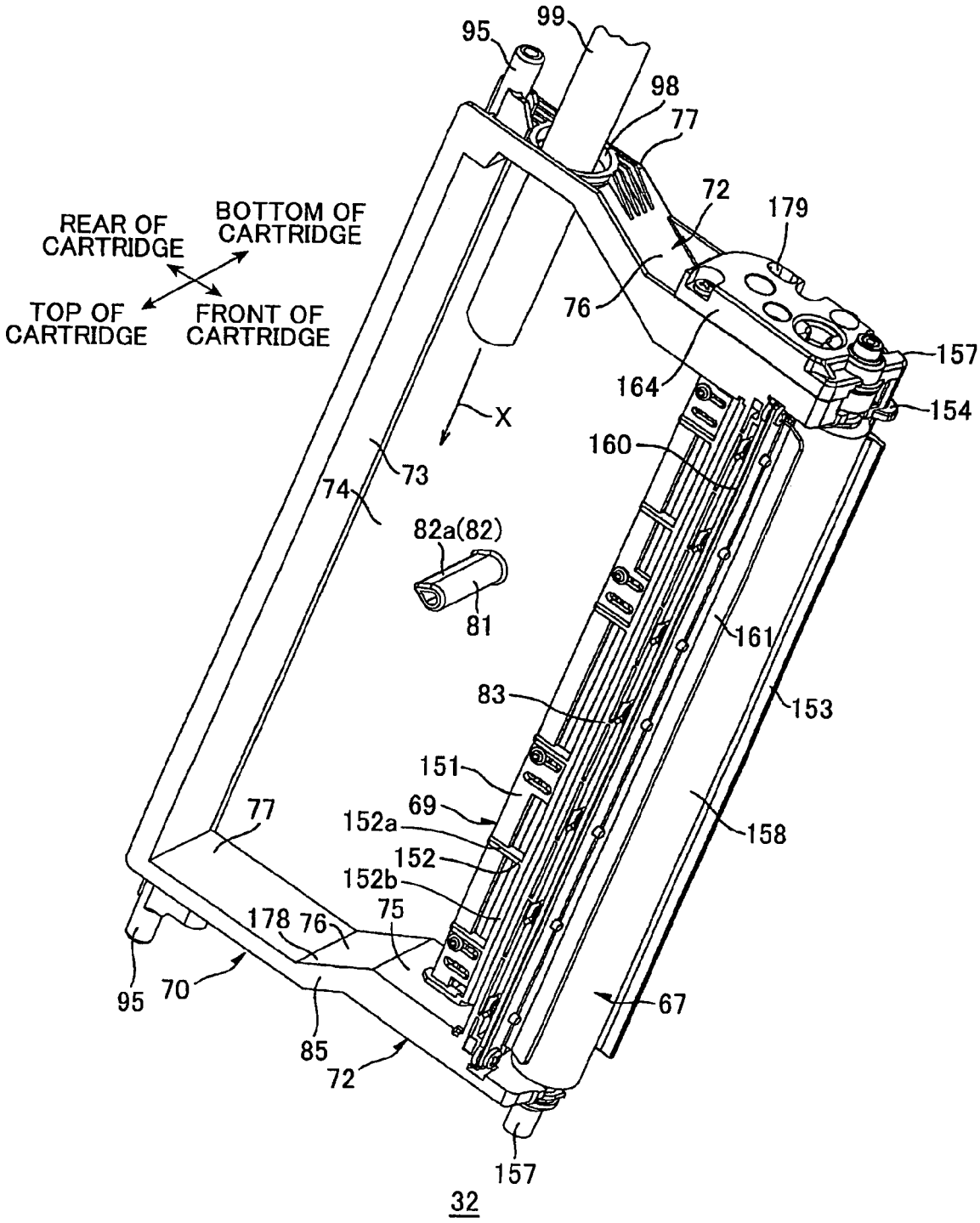
FIG. 19 is a exploded perspective view illustrating how the developer cartridge is filled with toner.

As shown in FIG. 19, a toner-filling nozzle 99 formed of a straight tube may be inserted into the toner fill through-hole 98 to fill the toner-accommodating chamber 92 with toner. The toner-filling nozzle 99 introduces toner along a line X extending from the toner-filling nozzle 99 in the filling direction. The reinforcing post 65 is disposed at a position that does not overlap the extended line X, but is further forward from the extended line X.

As shown in FIG. 8, The toner fill through-hole 98 is normally covered with a cap 165.

Figure 12:
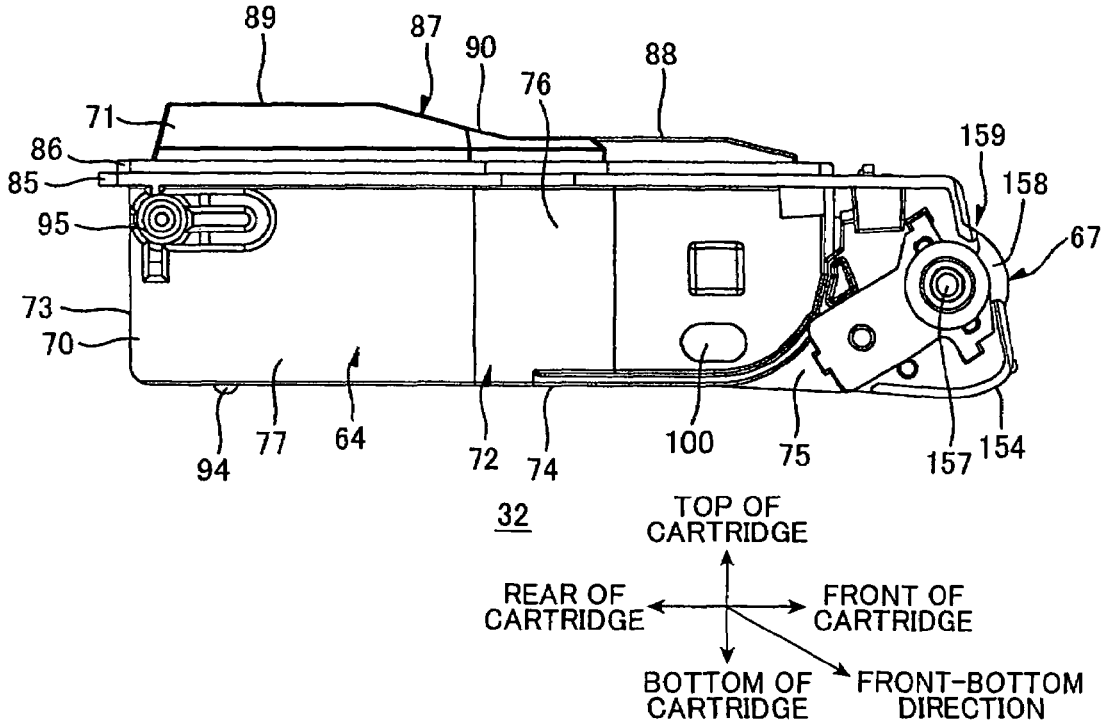
FIG. 12 is a left side view of the developer cartridge.
Figure 13:
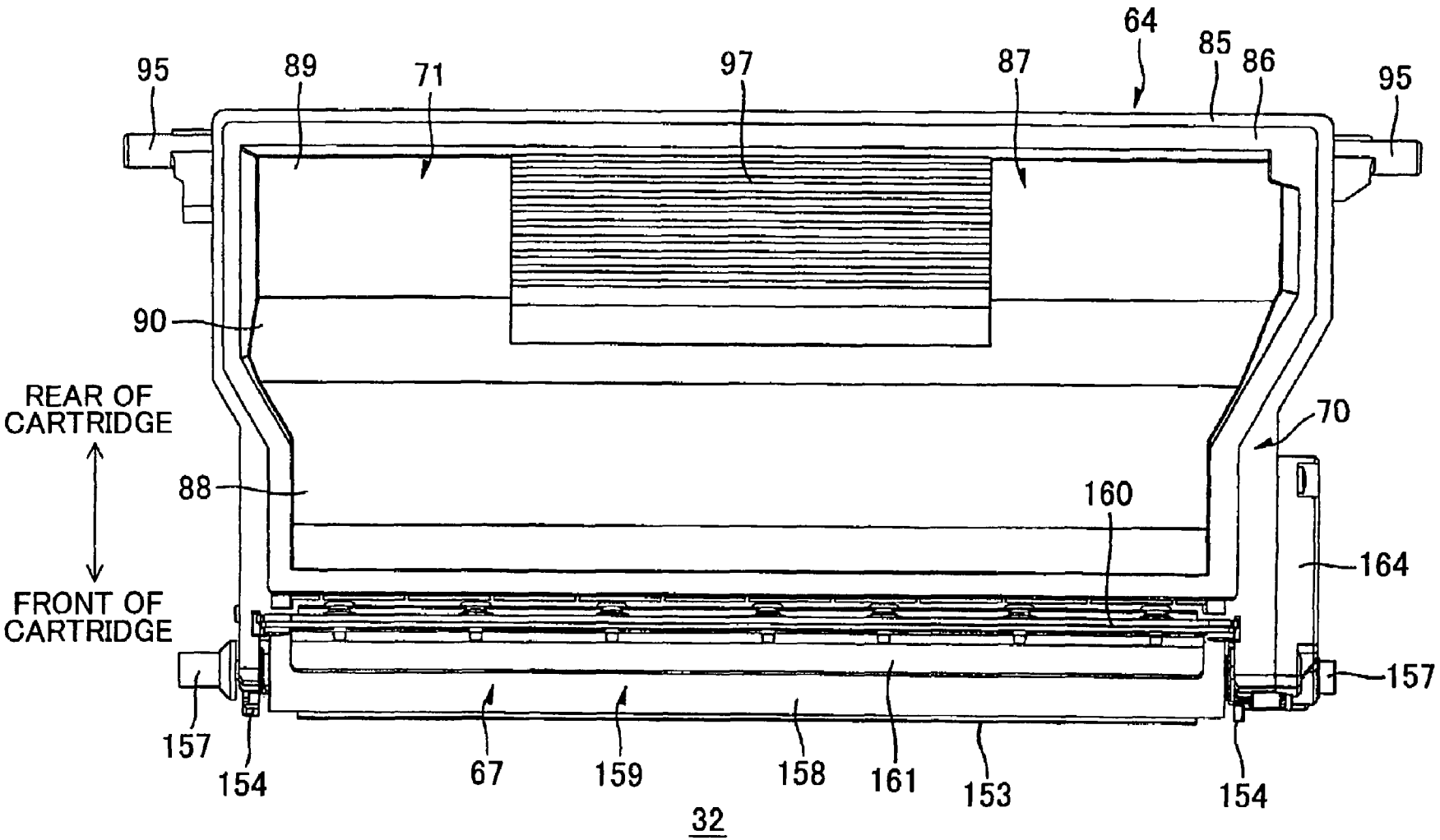
FIG. 13 is a plan view of the developer cartridge.

As shown in FIGS. 11 and 12, detection windows 100 are formed one in each front side wall 75 of the toner-accommodating chambers 92 at corresponding positions in the widthwise direction. The detection windows 100 allow the passage of a detection light from one to the other of the front side walls 75 to detect the amount of toner accommodated in the toner-accommodating chamber 92.

As shown in FIG. 16, the reinforcing post 65 is disposed at a position that does not overlap the optical path of the detection light passing through the detection windows 100 in the widthwise direction, but is positioned farther rearward of the optical path.

The agitator 69 is disposed inside the toner-accommodating chamber 92 near the discharge opening 84. As shown in FIG. 18, the agitator 69 includes a rotational shaft 151 that is rotatably supported between the front side walls 75; and a pair of agitating members 152 provided on the rotational shaft 151. In FIGS. 15, 16, and 19, only one of the pair of agitating members 152 is shown for clarity. Each agitating member 152 has a latticed plate shape (see FIG. 15), and protrudes radially from the same. More specifically, as shown in FIG. 19, each agitating member 152 has: a plurality of plates 152*a*, which are arranged along the axis of the rotational shaft 151 with gaps therebetween and each of which protrudes radially outwardly from the rotational shaft 151; and a connection plate 152*b* that extends parallel to the axis of the rotational shaft 151 and that connects the tip ends of the plates 152*a* with one another. The agitator 69 is disposed near the discharge opening 84 so that the agitating members 152 rotate along the discharge wall 78. The outer circular path is defined by the agitating members 152 when the agitating members 152 rotate around the rotational shaft 151. The area of the outer circular path that is projected along the axial direction of the rotational shaft 151 onto each side wall 72 is referred to as an agitator-projected area. The detection windows 100 are formed in the front side walls 75 at positions opposing each other in the widthwise direction so as to overlap the agitator-projected area in the front-to-rear direction. In other words, the detection windows 100 are positioned within the agitator-projected areas in the front side walls 75.

The reinforcing post 65 is positioned rearward of the agitator 69 in a position that does not overlap the outer circular path of the rotational path of the agitating member 152, so that the reinforcing post 65 is not contacted by the rotating agitating member 152. In other words, assuming that the area of the reinforcing post 65 that is projected in a direction parallel to the axial direction of the rotational shaft 151 onto each side wall 72 is referred to as a post-projected area, the post-projected area does not overlap the agitator-projected area on each side wall 72.

As shown in FIG. 15, the toner fill through-hole 98 is also disposed on the side wall 72 at a location rearward of the agitator 69 so as not to overlap the agitator-projected area on the side wall 72.

As shown in FIG. 1, when the developer cartridge 32 is mounted in the color laser printer 1, the toner-accommodating chambers 92 are located in the upper portion of the developer casings 64 (the rear portion in FIG. 8) for accommodating toner of each color used by the color laser printer 1. In the preferred embodiment, the toner-accommodating chambers 92 of each process section 27 accommodate a nonmagnetic, single-component polymerized toner having a positive charging nature. The toner-accommodating chamber 92 of the yellow process section 27Y accommodates a yellow toner, the toner-accommodating chamber 92 of the magenta process section 27M a magenta toner, the toner-accommodating chamber 92 of the cyan process section 27C a cyan toner, and the toner-accommodating chamber 92 of the black process section 27K a black toner.

More specifically, the toner for each color used in the preferred embodiment is a substantially spherical polymerized toner obtained by a polymerization method. The primary component of the polymerized toner is a binding resin obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The base particles are formed by compounding this binding resin with a coloring agent, a charge-controlling agent, wax, and the like. An additive to improve fluidity is also mixed with the base toner particles.

The coloring agent compounded with the binding resin provides one of the colors yellow, magenta, cyan, and black. The charge-controlling agent is a charge-controlling resin obtained by copolymerizing an ionic monomer having an ionic functional group, such as ammonium salt with a monomer that can be copolymerized with an ionic monomer, such as a styrene monomer or an acrylic monomer. The additive may be powder of a metal oxide, such as silica, aluminum oxide, titanium oxide, strontium titanate, cerium oxide, or magnesium oxide, or an inorganic powder, such as a carbide powder or metal salt powder.

As shown in FIG. 16, the developing chamber 93 is provided adjacent to the toner-accommodating chamber 92 and in front of the same and is in fluid communication with the toner-accommodating chamber 92 via the discharge opening 84.

An opening 159 is formed on the front end of the developer cartridge 32 so that the developing chamber 93 is open over a region from the top surface side to the front side. As shown in FIG. 8, a jaw part 153 is formed on the front end of the tongue wall 80 across the entire width of the developer cartridge 32. The jaw part 153 opposes the peripheral surface of the developing roller 67 disposed in the developing chamber 93 and contacts the bottom surface side of the same to prevent toner from leaking outward.

As shown in FIGS. 11 and 12, runners 154 are formed on the front part on the bottom surface side of the front side walls 75 at positions opposing the jaw part 153 in the widthwise direction. The runners 154 are formed similar to a curved L shape in a side view and protrude further than the jaw part 153 in the front-bottom direction as indicated in the figures. As shown in FIG. 16, the supply roller 66 is disposed in the developing chamber 93 in front of the discharge opening 84 and extends in the widthwise direction so as to be accommodated in the supply roller accommodating wall 79.

The supply roller 66 includes a metal supply roller shaft 155 rotatably supported between the front side walls 75; and a supply roller layer 156 formed of an electrically conductive sponge member that covers the periphery of the supply roller shaft 155.

The developing roller 67 is disposed in the developing chamber 93 at a position diagonally forward and toward the top surface side from the supply roller 66 and extends in the widthwise direction so as to confront the tongue wall 80. The developer roller 67 includes a metal developer roller shaft 157 that is rotatably supported between the front side walls 75 and a developer roller layer 158 formed of an electrically conductive rubber material that covers the developer roller shaft 157. More specifically, the developer roller layer 158 has a two-layer construction including an elastic roller layer formed of an electrically conductive urethane rubber, silicone rubber, or EPDM rubber containing fine carbon particles or the like, and a coating layer covering the surface of the roller layer and having the primary component of urethane rubber, urethane resin, polyimide resin, or the like.

The developing roller 67 and supply roller 66 are disposed so as to contact each other with pressure. As shown in FIG. 16, the developing roller 67 is disposed in the front end of the developing chamber 93 so that the front surface of the developing roller 67 is exposed through the opening 159. As described above, the jaw part 153 contacts the developing roller 67 with pressure on the bottom surface of the exposed front part.

The thickness-regulating blade 68 is provided on the front surface of the partitioning wall 83 across the entire width of the same. As shown in FIG. 16, the thickness-regulating blade 68 includes a blade 160 formed of a metal leaf spring member; a fixing member 161 for gripping the top surface side end of the blade 160 and fixing the blade 160 to the front surface of the partitioning wall 83; and a pressing part 162 disposed on the bottom surface side end of the blade 160. The pressing part 162 has a semicircular cross-section and is formed of an insulating silicone rubber. The thickness-regulating blade 68 is disposed so that the blade 160 extends in the thickness direction of the developer cartridge 32, with the top surface side end fixed to the front surface of the partitioning wall 83 by the fixing member 161, and so that the pressing part 162 provided on the bottom surface side end is pushed against the rear side of the developer roller layer 158 on the developing roller 67 by the elastic force of the blade 160.

As shown in FIGS. 8 and 11, a gear train (not shown), an agitator drive gear (not shown), a supply roller drive gear (not shown), and a developer roller drive gear (not shown) are provided on the outer surface of the front side wall 75 on one of the side walls 72. The gear train transfers a driving force to the agitator drive gear (not shown), the supply roller drive gear (not shown), and the developer roller drive gear (not shown). The agitator drive gear (not shown) is disposed on an end of the rotational shaft 151 protruding from the outer surface of the same side wall 72. The supply roller drive gear (not shown) is provided on an end of the supply roller shaft 155 protruding from the outer surface of the same side wall 72. The developer roller drive gear (not shown) is provided on an end of the developer roller shaft 157 protruding from the outer surface of the same side wall 72. A female coupling part 163 for inputting a driving force into the gear train is also provided on the outer surface of the front side wall 75 on the same side wall 72. The gear train and the female coupling part 163 are accommodated in and supported by a gear cover 164 disposed on the outer surface of the front side wall 75.

A cover detection through-hole 179 is formed in the gear cover 164 at a position corresponding to one of the detection windows 100 in the widthwise direction. In a side view, the cover detection through-hole 179 has a substantially elliptical shape corresponding to the detection window 100 that is elongated in the front-to-rear direction.

As shown in FIG. 17, guiding grooves 101 are formed in each of the process-accommodating sections 12. By inserting both ends of the drum shaft 60 in the drum cartridge 31 into the corresponding guiding grooves 101, the guiding grooves 101 guide the drum cartridge 31 as the drum cartridge 31 is mounted into or removed from the main casing 2. The guiding grooves 101 are formed as depressions in the inside surfaces of the left side plate 8 and right side plate 9 at corresponding positions in the widthwise direction, slanting rearward from top to bottom along the mounting direction of the drum cartridges 31 as shown in FIG. 18.

The lower end (deepest end) of each guiding groove 101 is a receiving part 102 for receiving the drum shaft 60. The receiving part 102 is formed as a depression in which the drum shaft 60 perfectly fits in the front-to-rear direction and is positioned so that, when the drum shaft 60 is received in the receiving parts 102, the photosensitive drum 42 is positioned in contact with a conveying belt 168 described later.

Drum positioning grooves 103 are formed in the left side plate 8 and right side plate 9 at corresponding widthwise positions. The drum positioning grooves 103 are located at the midway positions in the lengths of the guiding grooves 101. The drum positioning grooves 103 are depressions that are rectangular-shaped in a side view and open on the front for receiving the drum bosses 56.

As shown in FIG. 17, boss insertion grooves 133 are formed in the upper side of the guiding grooves 101 as cutout portions in the left side plate 8 and right side plate 9 for receiving the developer boss parts 95 of the developer cartridge 32. The boss insertion grooves 133 are formed as straight, substantially elongated U-shaped notches in the upper ends of the left side plate 8 and right side plate 9 that slant rearward from top to bottom along the mounting direction of the developer cartridge 32, that is, along a path that the developer boss parts 95 move when the developer cartridge 32 is mounted or removed.

With the color laser printer 1 according to the preferred embodiment, as shown in FIG. 18, each drum cartridge 31 is mounted in the main casing 2 by mounting the drum cartridge 31 for each color into the corresponding drum-accommodating section 13 of the corresponding process-accommodating section 12. Subsequently, the developer cartridge 32 of each color is mounted into the corresponding developer-accommodating section 14 and is thereby mounted on the corresponding drum cartridge 31.

More specifically, to mount the drum cartridge 31 in the drum-accommodating space 15 of the process-accommodating section 12, the user grips the drum grip 57, inserts the drum bosses 56 of the drum cartridge 31 into the corresponding guiding grooves 101, and pushes the drum cartridge 31 downward, as shown in FIG. 18. As a result, the drum cartridge 31 passes through the developer-accommodating section 14, and is finally mounted in the drum-accommodating section 13.

When the holder unit 43 of the drum cartridge 31 passes through the developer-accommodating space 16 of the developer-accommodating section 14, the ridges 51 of the drum cartridge 31 frequently slide against the rail parts 17 of the developer-accommodating section 14 as the drum cartridge 31 is mounted. In this way, since the ridges 51 protrude toward the rail parts 17 and the rail parts 17 are formed of thick strips, the ridges 51 contact the rail parts 17 to form a gap between the front wall 34 of the scanner casing 35 and the top wall 46 opposing the front wall 34, thereby preventing the top wall 46 from rubbing against the front wall 34 of the scanner casing 35.

Then, the drum bosses 56 are inserted into the corresponding drum-positioning grooves 10.3. As a result, the drum cartridge 31 is accommodated in the drum-accommodating space 15 with the extended part 44 accommodated in the extended accommodating space 18 of the developer-accommodating section 14. In this way, the drum cartridge 31 is mounted in the main casing 2.

In the color laser printer 1 having the construction described above, the front wall 34 of the scanner casing 35 protrudes into the process-accommodating section 12 toward the developer-accommodating space 16, restricting passage of the drum cartridge 31 through the developer-accommodating section 14 when the developer cartridge 32 is mounted on the drum cartridge 31 in the developer-accommodating section 14. However, the drum cartridge 31 is allowed to pass through the developer-accommodating space 16 of the developer-accommodating section 14 when the developer cartridge 32 is separated from the drum cartridge 31.

By forming the front wall 34 of the scanner casing 35 to expand toward the developer-accommodating space 16, the drum cartridge 31 can be passed through the developer-accommodating space 16 without conflicting with the front wall 34 of the scanner casing 35 and can be mounted in the drum-accommodating section 13 and accommodated in the drum-accommodating space 15 when separated from the developer cartridge 32, without simply allocating additional space for the mounting paths of the drum cartridge 31 and the developer cartridge 32. Subsequently, as described below, the developer cartridge 32 can be mounted in the developer-accommodating section 14 and accommodated in the developer-accommodating space 16, thereby completing the process of mounting both the drum cartridge 31 and developer cartridge 32.

When the holder unit 43 is accommodated in the drum-accommodating space 15 of the drum-accommodating section 13, the ridges 51 pass over the rail parts 17 to a position below the scanner casing 35, as shown in FIG. 18. At this time, the top portion of the charger 62 is disposed below the scanner casing 35. In addition, the photosensitive drum 42 is in contact with the conveying belt 168 described later.

Next, the user grips the developer cartridge 32 on the bottom grip part 96 and top side grip part 97, lines up the developer bosses 95 with the corresponding boss insertion grooves 133, as shown in FIG. 17, and pushes the developer cartridge 32 downward. The developer bosses 95 are inserted into the corresponding boss insertion grooves 133 and the developer cartridge 32 is accommodated in the developer-accommodating space 16 and is mounted on the drum cartridge 31, which has previously been mounted in the main casing 2.

Further, when mounting the developer cartridge 32 as described above, the runners 154 of the developer casing 64 contact the rear surface 33 of the partitioning plate 10 before the jaw part 153, and the runners 154 slide along the rear surface 33 of the partitioning plate 10 as the developer cartridge 32 is mounted. This construction can prevent damage to the jaw part 153 and can reliably prevent toner from leaking from the peripheral surface of the developing roller 67.

When an image-forming operation is not being performed in the color laser printer 1, a separating mechanism (not shown) holds the developer cartridge 32 in a separated state from the drum cartridge 31 so that the developing roller 67 is separate from the photosensitive drum 42. During an image-forming operation, the developer cartridge 32 is moved to a contact position so that the photosensitive drum 42 and developing roller 67 are in contact with each other.

By fitting the developer roller shaft 157 of the developing roller 67 into the developer positioning groove 48 of the drum casing 41 when the developer cartridge 32 is mounted on the drum cartridge 31, the developer cartridge 32 can be positioned in relation to the drum cartridge 31 so that the developer cartridge 32 can be selectively switched between the separated position and the contact position in the developer-accommodating section 14. The developer cartridge 32 can also be positioned in relation to the developer-accommodating section 14 by placing the contact protrusions 94 on the bottom wall 74 of the developer casing 64 in contact with the rear surface 33 of the partitioning plate 10.

When mounted and positioned in this way, each of the developer cartridges 32 is disposed at a slant to the vertical, as shown in FIG. 18, so that the opening 159 is positioned on the lower-rear side and the rear wall 73 on the upper-front side. More specifically, the discharge opening 84 is positioned below the toner-accommodating chamber 92, and the agitator 69 is disposed above the discharge opening 84. Further, the supply roller 66 and developing roller 67 are disposed below the toner-accommodating chamber 92 so that a line Z extending vertically downward from the rotational shaft 151 of the agitator 69 intersects with a line segment Y connecting the supply roller shaft 155 of the supply roller 66 to the developer roller shaft 157 of the developing roller 67.

When the drum cartridge 31 is mounted in the drum-accommodating section 13, the photosensitive drum 42 is electrically grounded through a connection with contact points (not shown). During an image-forming operation, a charge bias is applied to the charger 62. Also during an image-forming operation, a driving force inputted from a motor (not shown) rotates the photosensitive drum 42 through the engagement of gears (not shown).

When the developer cartridge 32 is mounted in the developer-accommodating section 14, a connection is made with contact points (not shown), enabling a developing bias to be applied to the developer roller shaft 157 of the developing roller 67 during an image-forming operation. Further, a male coupling part (not shown) is engaged with the female coupling part 163, so that a driving force from the motor (not shown) can be inputted during an image-forming operation to rotate the agitator 69, supply roller 66, and developing roller 67.

During an image-forming operation, toner accommodated in the toner-accommodating chamber 92 of each developer cartridge 32 corresponding to each color shifts vertically downward by its own weight toward the discharge opening 84 and is discharged through the discharge opening 84 as the agitator 69 rotates. Toner discharged through the discharge opening 84 is supplied onto the supply roller 66 and in turn is supplied onto the developing roller 67 as the supply roller 66 rotates. At this time, a developing bias is applied to the developing roller 67 and the toner is positively tribocharged between the supply roller 66 and the developing roller 67.

As the developing roller 67 rotates, the toner supplied to the surface of the developing roller 67 passes between the developer layer 158 of the developing roller 67 and the pressing part 162 of the thickness-regulating blade 68 so that the thickness-regulating blade 68 can regulate the toner carried on the surface of the developing roller 67 at a fixed thin layer.

In the meantime, a charge bias is applied to the charger 62 in the drum cartridge 31, causing the charger 62 to generate a corona discharge to apply a uniform positive charge to the surface of the photosensitive drum 42. As the photosensitive drum 42 rotates, the surface of the photosensitive drum 42 is exposed to the high-speed scan of a laser beam emitted from the scanning unit 30. The scanning unit 30 forms an electrostatic latent image on the surface of the photosensitive drum 42 corresponding to an image to be formed on the paper 3.

As the photosensitive drum 42 rotates further, the electrostatic latent image formed on the surface of the photosensitive drum 42 comes into contact with the positively charged toner carried on the surface of the developing roller 67. The toner on the surface of the rotating developing roller 67 is supplied to the latent image on the surface of the photosensitive drum 42, that is, is supplied to the exposed parts of the surface of the photosensitive drum 42 that have been exposed by the laser beam and, therefore, have a lower potential than other parts of the surface carrying a positive charge. In this way, the electrostatic latent image is developed into a visible toner image through a reverse developing process, and the toner image is carried on the surface of the photosensitive drum 42 for each color.

As shown in FIG. 1, the transfer section 28 is disposed in the main casing 2 above the feeder unit 4 and extends in the front-to-rear direction beneath the process-accommodating sections 12. The transfer section 28 includes a drive roller 166, a follow roller 167, the conveying belt 168, and transfer rollers 169. The drive roller 166 is disposed farther forward than the process-accommodating section 12 that accommodates the yellow process section 27Y. The follow roller 167 is disposed farther rearward than the process-accommodating section 12 that accommodates the black process section 27K.

The conveying belt 168 is an endless belt formed of a synthetic resin such as an electrically-conductive polycarbonate or polyimide containing dispersed conductive particles such as carbon. The conveying belt 168 is looped around the drive roller 166 and the follow roller 167. When the drive roller 166 is driven, the follow roller 167 follows the rotation of the drive roller 166, while the conveying belt 168 travels in a circuit between the drive roller 166 and follow roller 167. The outer surface of the conveying belt 168 opposes and contacts the photosensitive drum 42 in each process section 27 at an image-forming position and moves in the same direction as the surface of the photosensitive drum 42 at the point of contact.

The transfer rollers 169 are disposed inside the conveying belt 168 at positions opposing each photosensitive drum 42 with the conveying belt 168 interposed therebetween. The transfer rollers 169 are configured of a metal roller shaft covered with a roller part that is formed of an elastic material such as a conductive rubber material. The transfer rollers 169 are rotatably provided so that the surfaces of the transfer rollers 169 move in the same direction as the conveying belt 168 at the image-forming positions. A transfer bias is applied to the transfer rollers 169 during a transfer operation.

As described above, the conveying belt 168 moves in a circuit around the drive roller 166 and follow roller 167 when the drive roller 166 is driven and the follow roller 167 follows. When a sheet of paper 3 is supplied from the feeder unit 4, the conveying belt 168 conveys the paper 3 past each image-forming position between the conveying belt 168 and the photosensitive drum 42 of the process sections 27 in sequence in the rearward direction. As the conveying belt 168 conveys the paper 3, toner images in each color conveyed on the photosensitive drums 42 of each process section 27 are transferred sequentially onto the paper 3, thereby forming a multicolor image on the paper 3.

Specifically, first a yellow toner image carried on the surface of the photosensitive drum 42 in the yellow process section 27Y is transferred onto the paper 3. Next, a magenta toner image carried on the surface of the photosensitive drum 42 in the magenta process section 27M is transferred onto the paper 3 and superimposed over the yellow toner image. This operation is repeated for transferring and superimposing the cyan toner image carried on the surface of the photosensitive drum 42 in the cyan process section 27C and the black toner image carried on the surface of the photosensitive drum 42 in the black process section 27K, producing a multicolor image on the paper 3.

To form multicolor images in this way, the color laser printer 1 is configured as a tandem type device in which the drum cartridge 31 and developer cartridge 32 are provided as a set in each process sections 27, and a set is provided for each color. Accordingly, the color laser printer 1 of the preferred embodiment forms toner images in each color at about the same speed as required for forming monochrome images, thereby achieving rapid color image formation. Hence, the color laser printer 1 of the preferred embodiment can form color images while maintaining a compact shape.

The fixing section 29 is disposed in the main casing 2 at a position rearward of the process-accommodating section 12 accommodating the black process section 27K and is aligned in the front-to-rear direction with the image-forming positions at points of contact between the photosensitive drums 42 and the conveying belt 168. The fixing section 29 includes a heating roller 170 and a pressure roller 171.

The heating roller 170 is configured of a metal tube, the surface of which is coated with a release layer. The metal tube accommodates a halogen lamp that extends along the axis of the heating roller 170. The halogen lamp heats the surface of the heating roller 170 to a fixing temperature. The pressure roller 171 is disposed in confrontation with the heating roller 170 for applying pressure thereto.

After the toner images have been transferred onto the paper 3, the paper 3 is conveyed to the fixing section 29. The fixing section 29 fixes the color image onto the paper 3 with heat as the paper 3 passes between the heating roller 170 and the pressure roller 171.

The discharge unit 6 includes a U-shaped discharge path 172, discharge rollers 173, and a discharge tray 174.

The discharge path 172 has a curved U shape and functions as a path for conveying the paper 3. The upstream end of the discharge path 172 is the lower section of the discharge path 172 and is positioned adjacent to the fixing section 29 for feeding the paper 3 in a rearward direction, while the downstream end of the discharge path 172 is the upper section and is positioned adjacent to the discharge tray 174 for discharging the paper 3 forward.

The discharge rollers 173 are a pair of rollers disposed near the downstream end of the discharge path 172. The discharge tray 174 is a surface formed on the top of the main casing 2 that slopes downward from the front to the rear side.

After a multicolor image is fixed on the paper 3 in the fixing section 29, the paper 3 is conveyed into the upstream end of the discharge path 172 in the rearward direction. The U-shaped discharge path 172 reverses the conveying direction of the paper 3, and the discharge rollers 173 discharges the paper 3 forward onto the discharge tray 174.

In the color laser printer 1 described above, the forward direction in which the pickup roller 22 picks up the paper 3 is opposite the rearward direction in which the paper 3 is conveyed past the image-forming positions. Further, the rearward direction in which the paper 3 is conveyed past the image-forming positions is opposite the forward direction in which the discharge rollers 173 discharge the paper 3. This construction enables the device to be made compact while providing conveying paths for the paper 3.

In the color laser printer 1 of the preferred embodiment described above, the drum cartridge 31 and developer cartridge 32 are mounted in the drum-accommodating section 13 and developer-accommodating section 14 of each process-accommodating section 12 at a slant to the front-to-rear direction (conveying direction of the paper 3 that is being conveyed while being formed with images) and the vertical direction (thickness direction of the paper 3 that is being conveyed while being formed with images). More specifically, the drum cartridge 31 and the developer cartridge 32 are mounted in a direction that slopes rearward from top to bottom. This construction can improve the operability of mounting and removing the drum cartridge 31 and developer cartridge 32.

In the color laser printer 1 of the preferred embodiment described above, the plurality of sets of the drum cartridge 31 and developer cartridge 32 are disposed alternately with the plurality of scanning units 30 in the front-to-rear direction, thereby achieving an efficient arrangement that can produce a compact device.

In the developer cartridge 32, the reinforcing post 65 provided in the toner-accommodating chamber 92 spans between the top wall 87 and the bottom wall 74 and can absorb stress applied between the top wall 87 and bottom wall 74 in a compressing direction, thereby improving the stiffness of the toner-accommodating chamber 92. Moreover, since the reinforcing post 65 is disposed inside the toner-accommodating chamber 92 between the top wall 87 and the bottom wall 74, the reinforcing post 65 can improve the stiffness of the toner-accommodating chamber 92 while maintaining the thinness of the developer cartridge 32, regardless of the outer shape of the developer cartridge 32, thereby making it possible to achieve a compact device.

In the developer cartridge 32 having this construction, the reinforcing post 65 is disposed in the widthwise center and front-to-rear center of the toner-accommodating chamber 92 at a position separate from the side walls 72, rear wall 73, and partitioning wall 83, thereby reinforcing the space in the toner-accommodating chamber 92 farther inward from the side walls 72, rear wall 73, and partitioning wall 83. This construction further improves the stiffness of the toner-accommodating chamber 92.

The reinforcing post 65 is also disposed rearward of the agitator 69 in a position that the post-projected area does not overlap the agitator-projected area on the side walls 72, so that the reinforcing post 65 is not contacted by the rotating agitating members 152. If the reinforcing post 65 were disposed in a position for contacting the agitator 69 so that the rotating agitating members 152 deform while sliding over the reinforcing post 65, this contact will apply an excessive load to the agitator 69 and generate noise.

However, by positioning the reinforcing post 65 so as not to contact the rotating agitating member 152 as in the preferred embodiment, it is possible to prevent an excessive load from being applied to the agitator 69 and to prevent the generation of noise.

Figure 20:
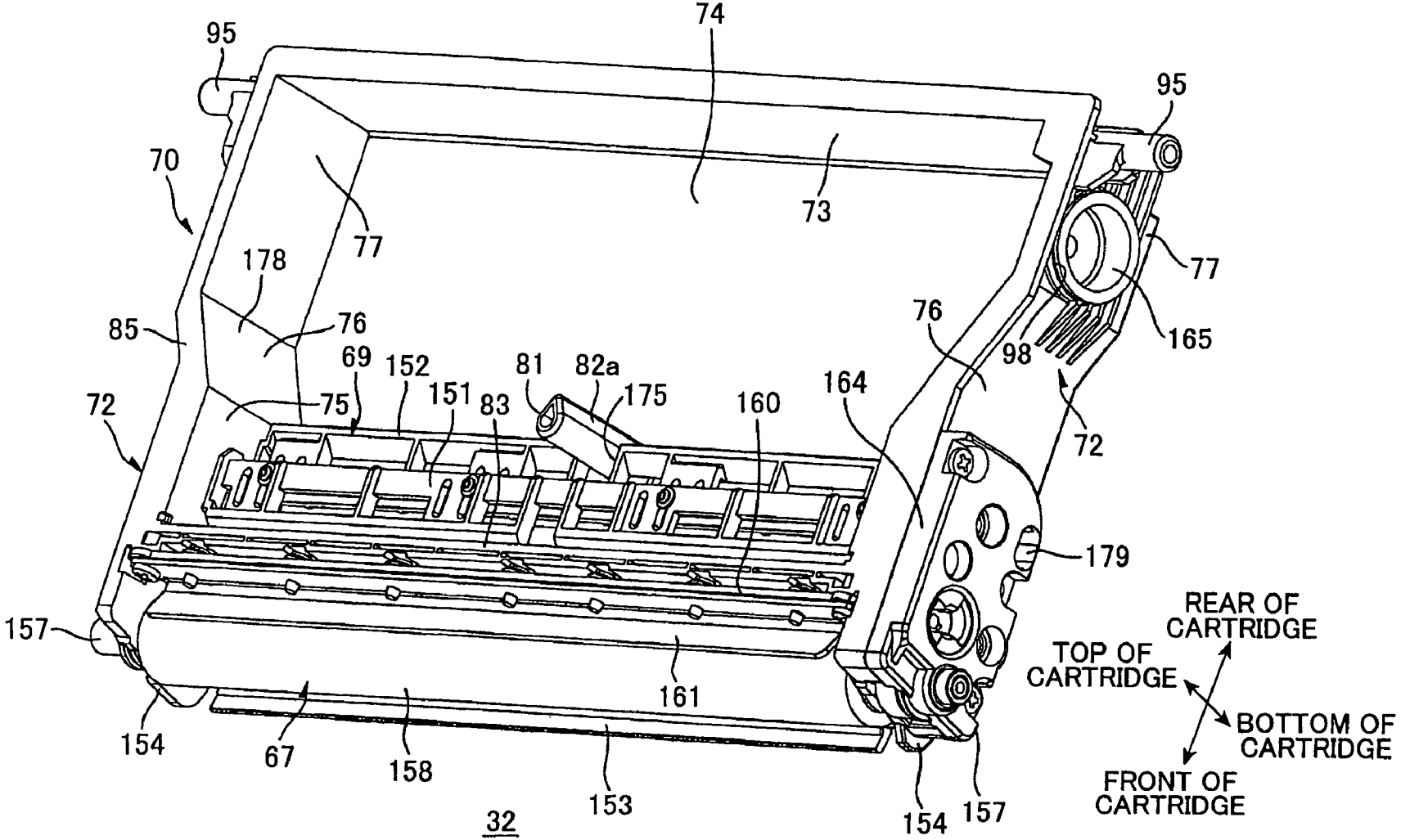
FIG. 20 is a perspective view of a developer cartridge according to a comparative example.

In a comparative example, a cutout part 175 is formed in the widthwise center of each agitating member 152, as shown in FIG. 20, and the reinforcing post 65 is disposed inside the cutout part 175. In this example, however, the agitating performance of the agitating member 152 will become irregular in the axial direction of the rotational shaft 151.

However, the reinforcing post 65 in the preferred embodiment (FIG. 15) is disposed at a position so that the post-projected area does not overlap the agitator-projected area, thereby maintaining the efficiency of the agitating member 152 without irregularities in the agitating performance.

Even though the agitator 69 is disposed near the discharge opening 84, the reinforcing post 65 reinforces the space in the section of the toner-accommodating chamber 92 on the opposite side of the agitator 69 from the discharge opening 84. Accordingly, it is possible to improve the stiffness of the toner-accommodating chamber 92 and ensure that toner can be smoothly discharged through the discharge opening 84.

Since the developer cartridge 32 has a thin shape, the operator can grip the bottom grip part 96 and top grip part 97 with one hand when mounting or removing the developer cartridge 32. This gripping action applies stress in a compressing direction to the top wall 87 and bottom wall 74 of the developer cartridge 32 in the region where the bottom grip part 96 and top grip part 97 are provided.

However, the reinforcing post 65 spans between the inner surface of the bottom wall 74 opposing the bottom grip part 96 and the inner surface of the top wall 87 opposing the top grip part 97, thereby reliably absorbing this stress in the compressing direction. Therefore, this construction improves the stiffness of the toner-accommodating chamber 92 and prevents the toner-accommodating chamber 92 from deforming when the operator grips the developer cartridge 32.

When the supporting post member 81 is fitted into the cylindrical fitting part 91, the resulting reinforcing post 65 has a teardrop-shaped cross-section with the tapered point of the teardrop shape pointing upstream in the direction that toner is discharged (upward when the developer cartridge 32 is mounted). The reinforcing post 65 has a substantially V-shaped tapered surface 82 along its rear side. The surface 82 is formed from the guide surface 82*a* and the guide surface 82*b*. The surface 82 serves as a guide surface for guiding toner in the discharging direction.

Hence, the guide surface 82 can smoothly guide toner downstream in the discharging direction (downward when the developer cartridge 32 is mounted), preventing the toner from accumulating around the reinforcing post 65. Further, since the guide surface 82 is formed in a tapered shape pointing upstream in the discharging direction, the toner is smoothly guided downstream in the discharging direction along the tapered guide surface 82, thereby reliably preventing toner from accumulating around the reinforcing post 65.

Fitting the supporting post member 81 of the bottom wall 74 in the cylindrical fitting part 91 provided on the top wall 87 forms the reinforcing post 65 that spans between the bottom wall 74 and top wall 87. Hence, the reinforcing post 65 can be reliably provided between the bottom wall 74 and top wall 87 by fitting the supporting post member 81 into the cylindrical fitting part 91, thereby reliably improving the stiffness of the toner-accommodating chamber 92.

As described above, the reinforcing post 65 is disposed in a position forward of the extended line X and not overlapping the extended line X. The extended line X is a line extending from the toner-filling nozzle 99 inserted through the toner fill through-hole 98 along the filling direction in which the toner-filling nozzle 99 introduces toner into the toner-accommodating chamber 92. In other words, the line X extends from the center of the toner fill through-hole 98 in a direction perpendicular to the side walls 72. This construction reduces the percentage of toner that directly contacts the reinforcing post 65 when the toner-filling nozzle 99 fills the toner-accommodating chamber 92 with toner, enabling the toner-accommodating chamber 92 to be smoothly filled with toner.

The toner fill through-hole 98 is disposed rearward of the agitator 69 so as not to overlap the agitator-projected area on the side wall 72. This construction reduces the percentage of toner that directly contacts the agitator 69 when filling the toner-accommodating chamber 92 with toner, enabling the toner-accommodating chamber 92 to be smoothly filled with toner. Moreover, by forming the toner fill through-hole 98 in one of the rear side walls 77, which are spaced farther apart than the front side walls 75, toner-filling efficiency can be improved.

By providing the supporting post member 81 on the plate-shaped bottom wall 74 and the cylindrical fitting part 91 on the plate-shaped center top wall 90, the toner-accommodating chamber 92 can be formed in a thin shape.

Further, the reinforcing post 65 is disposed at a position rearward of and not overlapping the optical path of the detection light transmitted between the detection windows 100. Therefore, the detection light can be reliably transmitted through the detection windows 100, thereby easily and reliably detecting the amount of residual toner.

In the developer cartridge 32 described above, the gear train (not shown) and the female coupling part 163 are provided on the outer surface of the front side wall 75 for transferring a driving force to the agitator 69, supply roller 66, and developing roller 67. If the axial length of the rotational shaft 151 for the agitator 69 were increased, the gear train and female coupling part 163 would be further expanded outward in the widthwise direction, making it difficult to manufacture a compact developer cartridge 32.

Hence, by setting the distance between the front side walls 75 at the position where the agitator 69 is provided shorter than the distance between the rear side walls 77 at the position on the opposite side of the agitator 69 from the discharge opening 84, it is possible to increase the capacity for accommodating developer by increasing the length between the rear side walls 77 at the position on the opposite side of the agitator 69 from the discharge opening 84. The gear cover holds the gears (not shown) and the female coupling part 163 on the outside surface of the front side wall 75 within a small, compact space.

By forming the sloped surface 188 on the inner surface of the sloped walls 76 for guiding toner in the discharging direction, a step part between the front side walls 75 and the rear side walls 77 can be eliminated, even though the distance between the front side walls 75 is shorter than the distance between the rear side walls 77. Accordingly, the sloped surfaces 178 prevent toner from accumulating between the front side walls 75 and rear side walls 77 and smoothly guide the toner to be discharged from the toner-accommodating chamber 92.

In the toner-accommodating chamber 92, the front top wall 88 and rear top wall 89 are disposed parallel to the bottom wall 74 such that the distance between the rear top wall 89 and the bottom wall 74 is greater than the distance between the front top wall 88 and the bottom wall 74. This construction increases the toner capacity in the rear portion of the developer cartridge 32 that is relatively unimpeded when the developer cartridge 32 is mounted or removed due to its relative position to the scanning unit 30 and the like. Hence, the toner capacity in the developer cartridge 32 can be increased while ensuring a smooth mounting and removal operation.

In the developer cartridge 32 described above, the developing roller 67 is disposed in the front end of the developing chamber 93, which is in fluid communication with the toner-accommodating chamber 92, so that the front surface of the developing roller 67 is exposed through the opening 159. Accordingly, toner accommodated in the toner-accommodating chamber 92 can be effectively discharged into the developing chamber 93 and effectively carried on the developing roller 67. Further, since the toner accommodated in the toner-accommodating chamber 92 shifts downward toward the discharge opening 84 by its own weight when the developer cartridge 32 is mounted in the developer-accommodating section 14, the smooth discharge of toner can be achieved through a simple structure.

Since the agitator 69 is disposed above and near the discharge opening 84 when the developer cartridge 32 is mounted in the developer-accommodating section 14, the agitator 69 can discharge toner, which has shifted toward the discharge opening 84 by its own weight, in uniform amounts through the discharge opening 84. Hence, this construction ensures that a stable amount of toner will be carried on the developing roller 67 to achieve reliable image formation.

When the developer cartridge 32 is mounted in the developer-accommodating section 14, the supply roller 66 and developing roller 67 are disposed below the toner-accommodating chamber 92, enabling the developer cartridge 32 to be manufactured in a thin shape. Further, the supply roller 66 and developing roller 67 are disposed below the toner-accommodating chamber 92 such that the vertical line Z extending vertically downward from the rotational shaft 151 of the agitator 69 intersects the line segment Y connecting the supply roller shaft 155 of the supply roller 66 with the developer roller shaft 157 of the developing roller 67, enabling the developer cartridge 32 to be manufactured in a even thinner shape.

Figure 21:
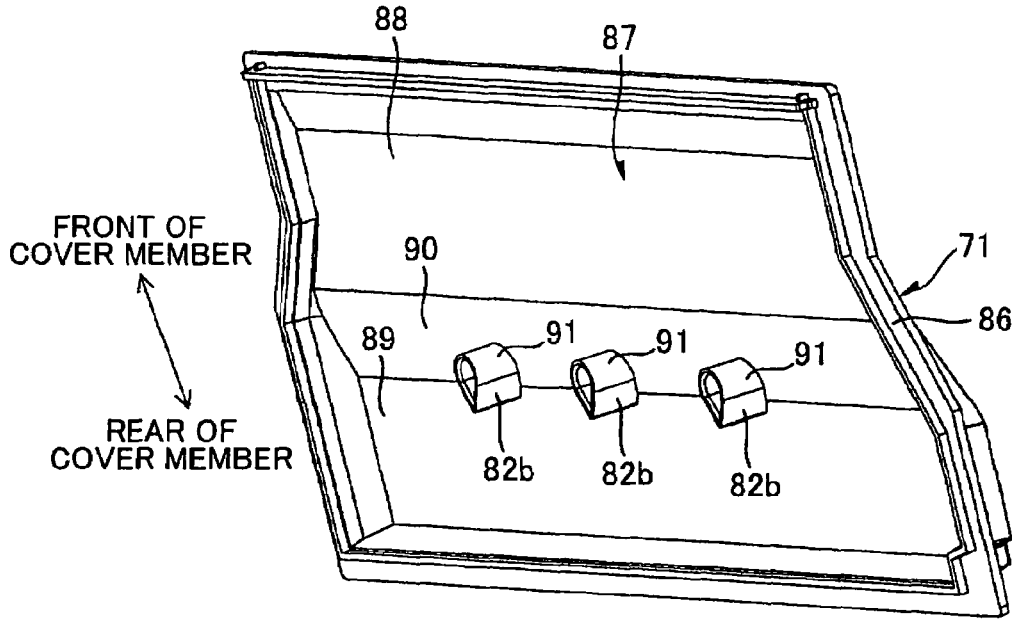
FIG. 21 is an exploded perspective view of a developer cartridge for the color laser printer in FIG. 1 according to a second embodiment.
Figure 21:
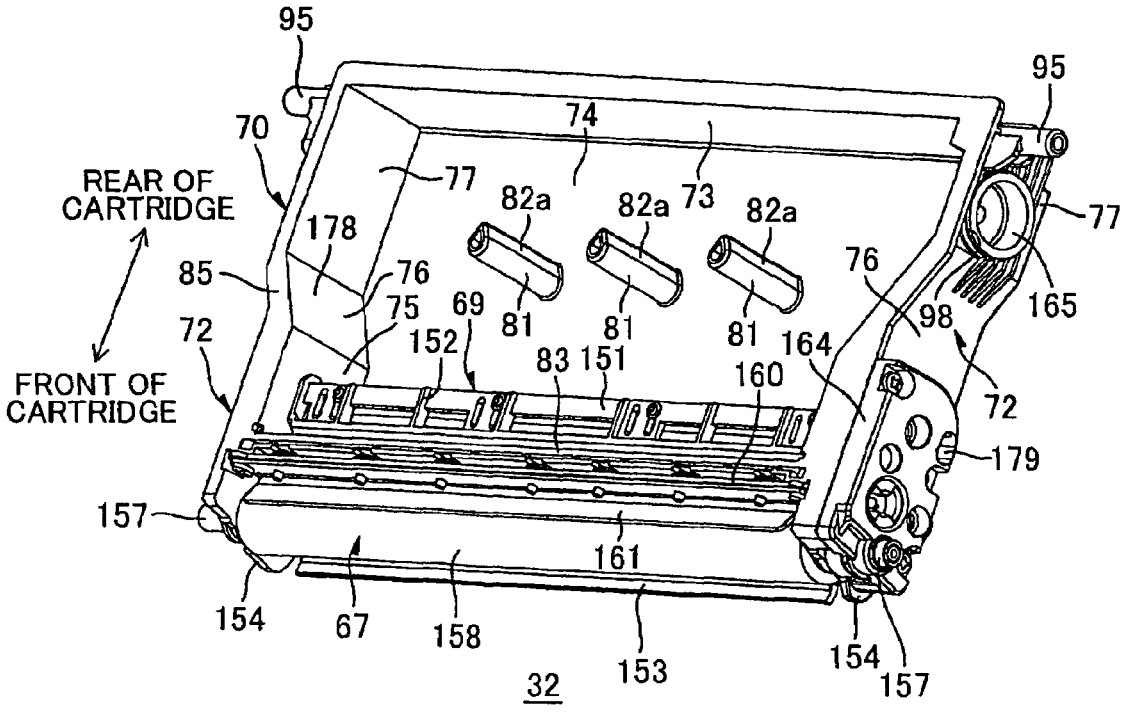

In the preferred embodiment described above, a single reinforcing post 65 is provided in the toner-accommodating chamber 92. However, in a second embodiment of the present invention, a plurality of reinforcing posts 65 is provided in the toner-accommodating chamber 92. FIG. 21 shows the developer cartridge 32 according to the second embodiment of the present invention, wherein like parts and components are designated with the same reference numerals to avoid duplicating description.

As shown in FIG. 21, three of the supporting post members 81 spaced at intervals in the widthwise direction are disposed on the inner surface of the bottom wall 74 between the front end and rear end thereof. Three of the cylindrical fitting parts 91 spaced at intervals in the widthwise direction are provided at corresponding positions on the inner surface of the center top wall 90 in the top wall 87.

In the developer cartridge 32 shown in FIG. 21, the three supporting post members 81 fit into the three cylindrical fitting parts 91 when the cover member 71 is closed over the casing member 70, forming three of the reinforcing posts 65. Providing a plurality of the reinforcing posts 65 in this way further improves the stiffness of the toner-accommodating chamber 92.

In the second embodiment described above, the reinforcing posts 65 are disposed on the inner surface of the bottom wall 74 at positions separate from the side walls 72, rear wall 73, and partitioning wall 83. However, reinforcing parts can be formed continuously with any of the side walls 72, rear wall 73, and partitioning wall 83.

Figure 22:
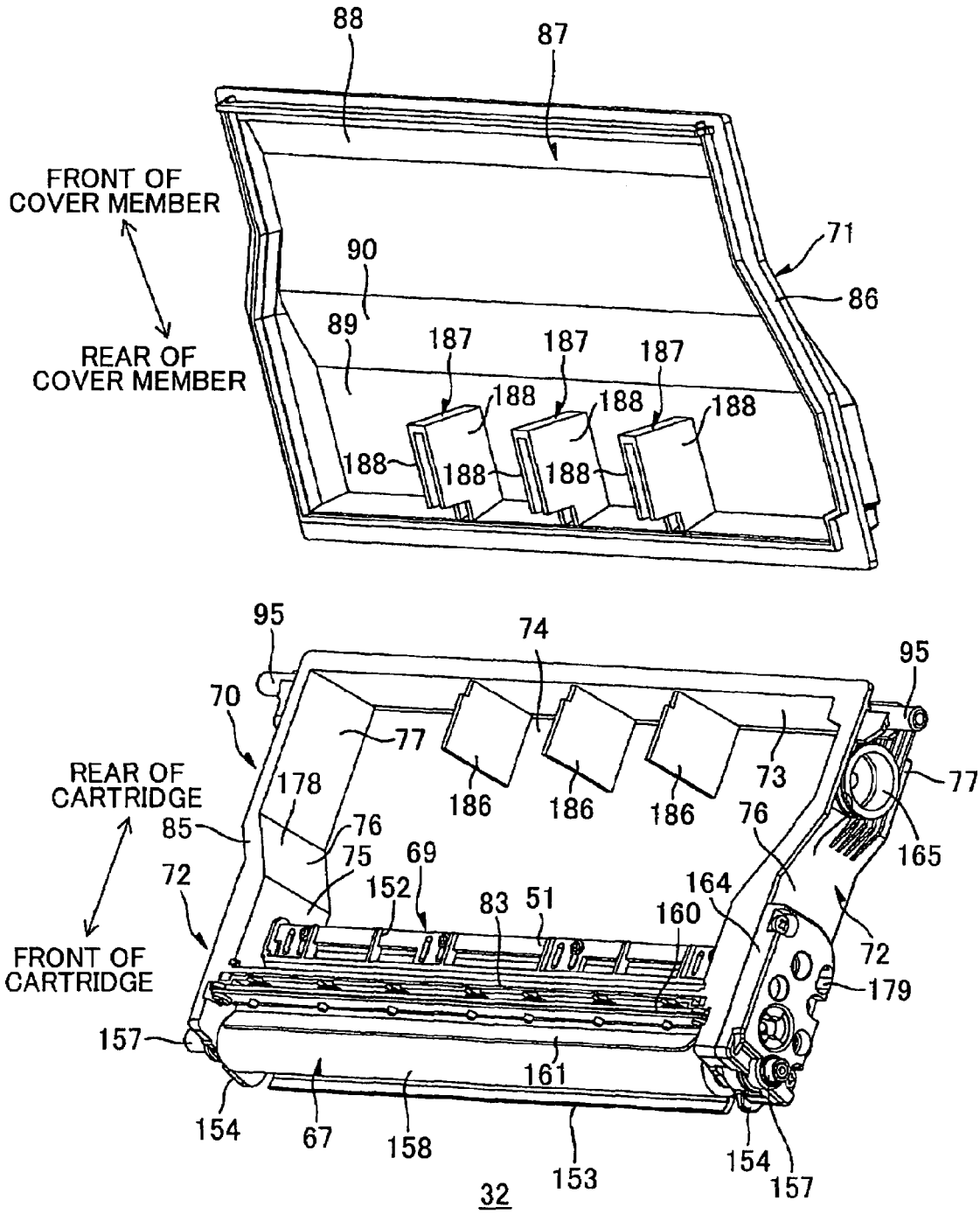
FIG. 22 is an exploded perspective view of a developer cartridge for the color laser printer in FIG. 1 according to a third embodiment.

For example, in a third embodiment of the present invention shown in FIG. 22, three reinforcing plates 186 formed continuously with the rear wall 73 are provided on the inner surface of the bottom wall 74, and three reinforcing plate receiving members 187 are provided on the inner surface of the rear top wall 89 corresponding to the positions of the reinforcing plates 186.

The reinforcing plates 186 are provided on the rear end of the bottom wall 74 erected toward the top surface side and are spaced at prescribed intervals from each other in the widthwise direction. The reinforcing plates 186 are also formed continuously with the inner surface of the rear wall 73 extending in the front-to-rear direction.

The reinforcing plate receiving members 187 are provided on the rear end of the rear top wall 89, extending in the front-to-rear direction and protruding downward toward the bottom surface side. The reinforcing plate receiving members 187 are spaced at prescribed intervals in the widthwise direction so as to correspond to the reinforcing plates 186. Each of the reinforcing plate receiving members 187 is formed of two gripping plates 188 facing each other across a gap for receiving and gripping the corresponding reinforcing plate 186.

In the developer cartridge 32 shown in FIG. 22, reinforcing parts spanning between the bottom wall 74 and the top wall 87 are formed when the cover member 71 is closed over the casing member 70, causing the three reinforcing plates 186 to become interposed between the three reinforcing plate receiving members 187.

Figure 23:
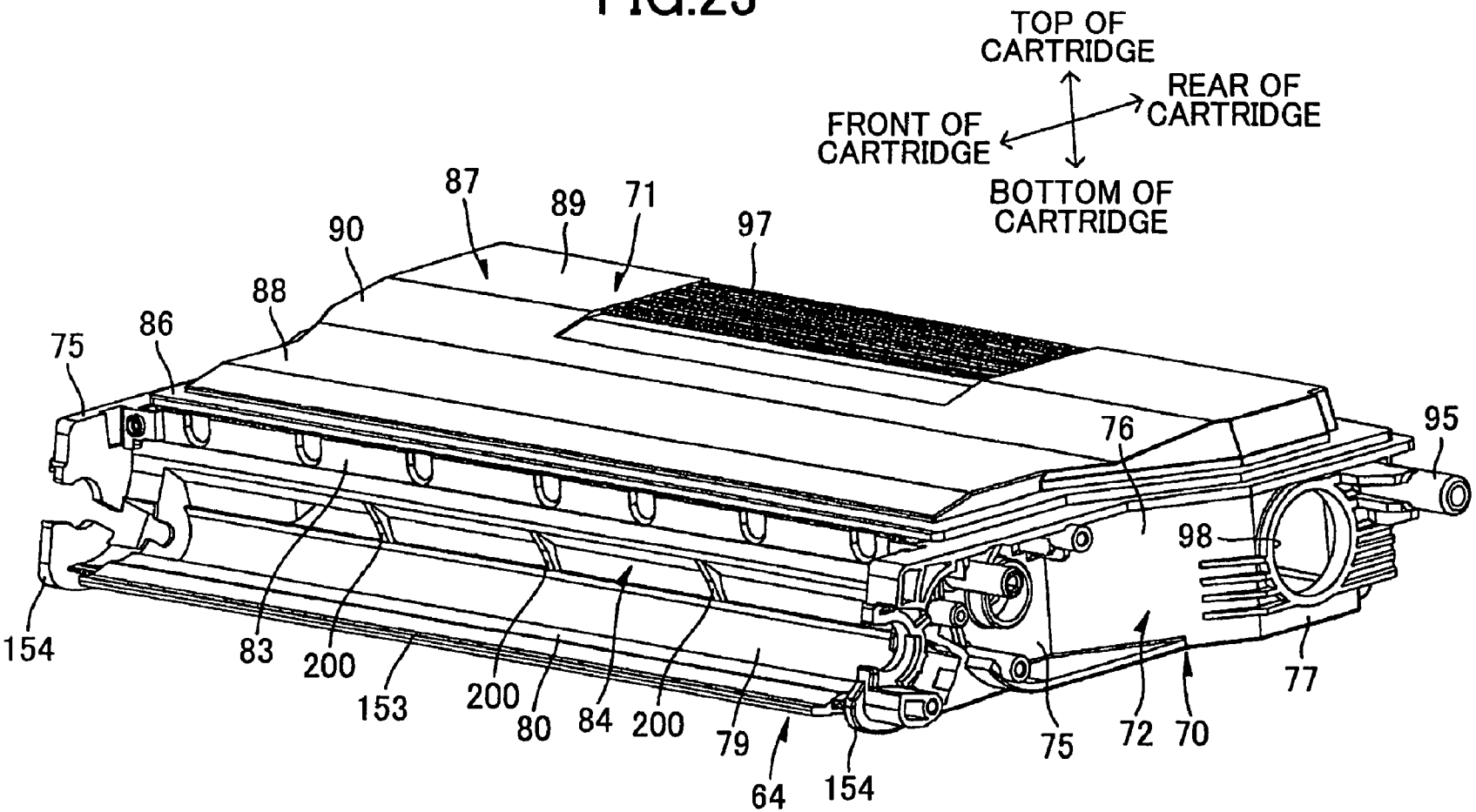
FIG. 23 is a perspective view from the top front side of a developer cartridge for the color laser printer in FIG. 1 according to a fourth embodiment.
Figure 24:
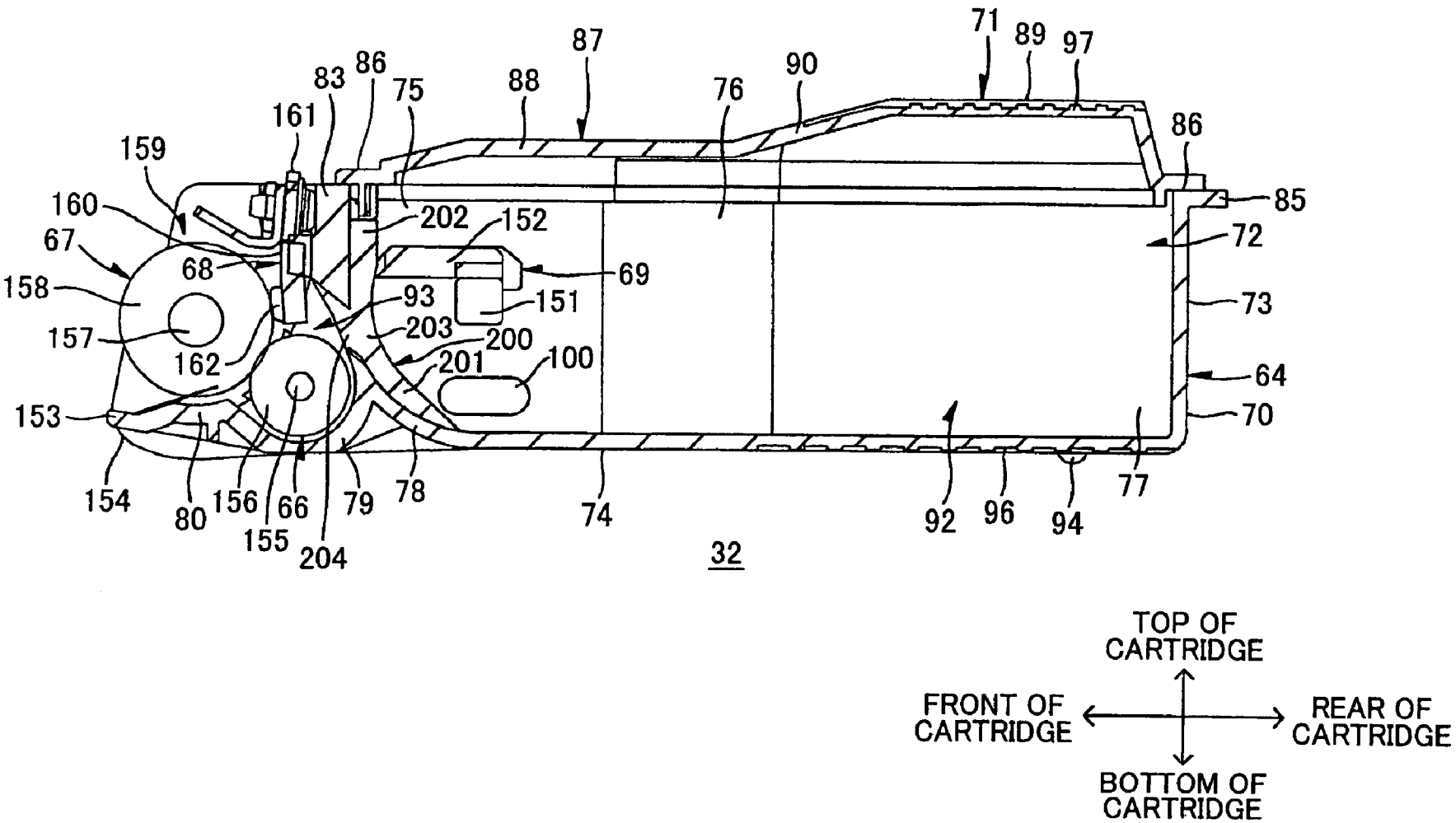
FIG. 24 is a side cross-sectional view of the developer cartridge according to the fourth embodiment.
Figure 25:
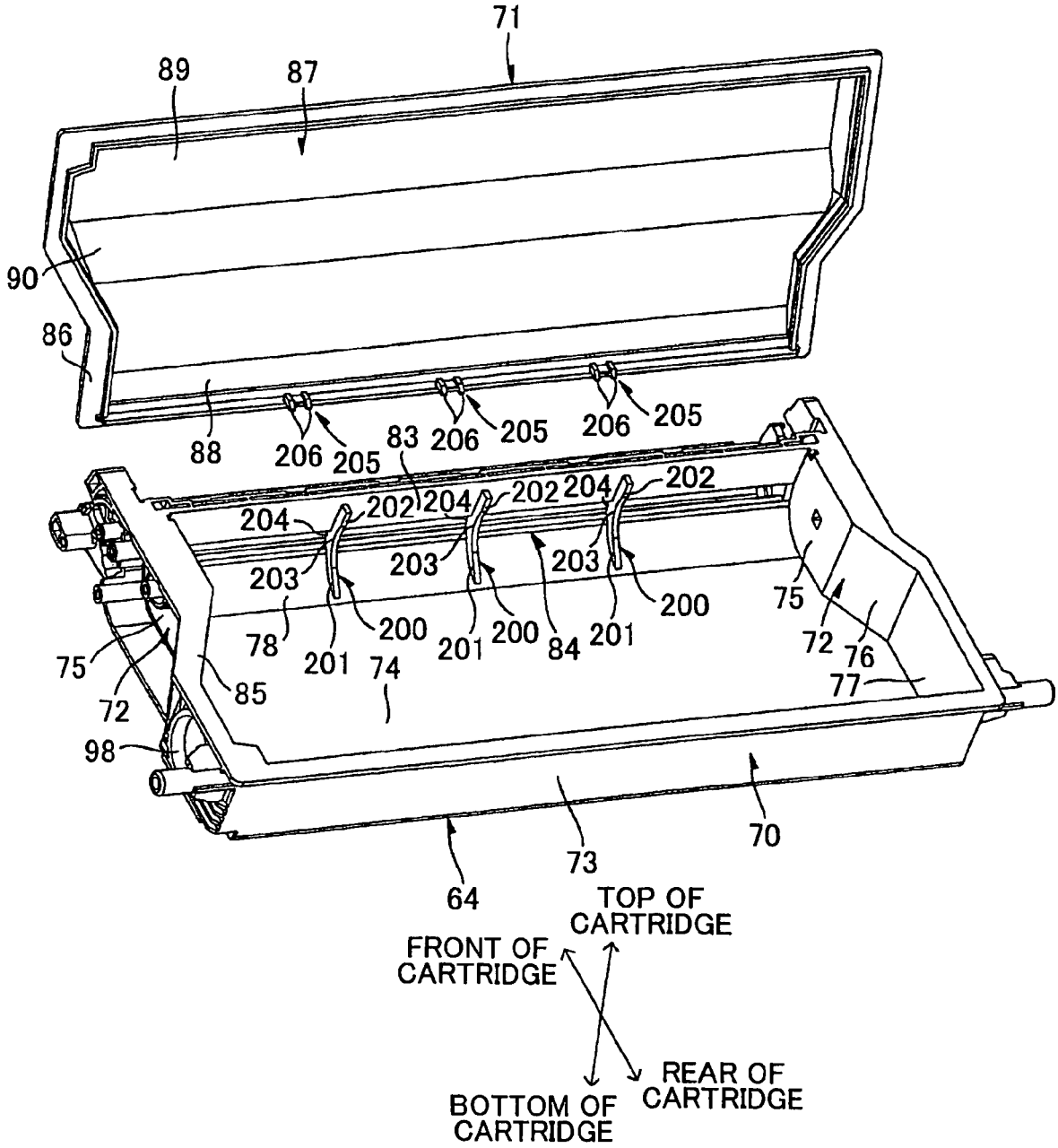
FIG. 25 is an exploded perspective view of the developer cartridge according to the fourth embodiment.

FIGS. 23 through 25 show the developer cartridge 32 according to a fourth embodiment of the present invention, wherein like parts and components are designated with the same reference numerals to avoid duplicating description. In the fourth embodiment of the present invention, reinforcing ribs 200 are juxtaposed in the discharge opening 84.

Specifically, as shown in FIGS. 24 and 25, the reinforcing ribs 200 protrude in the thickness direction adjacent to the discharge opening 84. In the preferred embodiment, three of the reinforcing ribs 200 are juxtaposed in the widthwise direction at prescribed intervals from each other.

Each of the reinforcing ribs 200 includes a bottom surface side end 201, and a top surface side end 202. The bottom surface side end 201 is erected on the inner surface of the discharge wall 78 and is formed continuously along the discharge wall 78, which protrudes toward the top surface side and which has an arc-shaped cross-section. Each of the top surface side ends 202 is erected from the rear surface of the partitioning wall 83 and is formed continuously along the rear surface of the partitioning wall 83.

The reinforcing rib 200 also includes a center part 203 that is disposed between the bottom surface side end 201 and top surface side end 202 and that crosses through the discharge opening 84 in the thickness direction of the developer cartridge 32, that is, orthogonal to the widthwise direction of the developer cartridge 32 in which the discharge opening 84 extends; and an insertion part 204 provided on the center part 203 that fits into the discharge opening 84. The end surface of the partitioning wall 83 on the bottom surface side slopes toward the top surface side from the rear end toward the front. Each of the insertion parts 204 is formed integrally with the corresponding center part 203, the top surface side end of the insertion parts 204 being formed to contact the entire bottom surface side end surface of the partitioning wall 83 and the bottom surface side end of the insertion part 204 being formed to contact the end surface on the top surface side of the connecting part between the front end of the discharge wall 78 and the rear end of the supply roller accommodating wall 79. The surface on the front side of the center part 203 is formed such that its top surface side end is flush with the front surface of the partitioning wall 83, and its bottom surface side end is flush with the front surface on the rear end of the supply roller accommodating wall 79.

As shown in FIG. 25, three reinforcing rib engaging parts 205 are provided on the contact part 86 on the front side of the cover member 71 at positions corresponding to the reinforcing ribs 200. Each of the reinforcing rib engaging parts 205 includes a pair of holding pieces 206 for gripping the corresponding reinforcing ribs 200 on the widthwise sides. In the developer cartridge 32 shown in FIGS. 24 and 25, reinforcing parts configured of the reinforcing ribs 200 and spanning between the bottom wall 74 and the top wall 87 are formed when the cover member 71 is closed over the casing member 70, interposing the top surface side ends of the reinforcing ribs 200 between the pairs of holding pieces 206 in the corresponding reinforcing rib engaging parts 205. With this construction, the discharge opening 84 is partitioned by the reinforcing ribs 200 into a plurality of openings spaced in the widthwise direction, as shown in FIG. 23.

Because the toner-accommodating chamber 92 and developing chamber 93 are formed in the developer cartridge 32, the discharge opening 84 is formed so that the toner-accommodating chamber 92 and developing chamber 93 are in fluid communication.

The reinforcing ribs 200 juxtaposed in the discharge opening 84 can reinforce the discharge opening 84, while allowing the smooth discharge of toner through the discharge opening 84. Accordingly, the reinforcing ribs 200 can absorb stress applied to the top wall 87 and bottom wall 74 in the compressing direction, thereby improving stiffness between the toner-accommodating chamber 92 and developing chamber 93. This construction can prevent the developer cartridge 32 from being dented or deformed and can prevent toner in the toner-accommodating chamber 92 from being accidentally ejected through the discharge opening 84 toward the developing roller 67.

Figure 26:
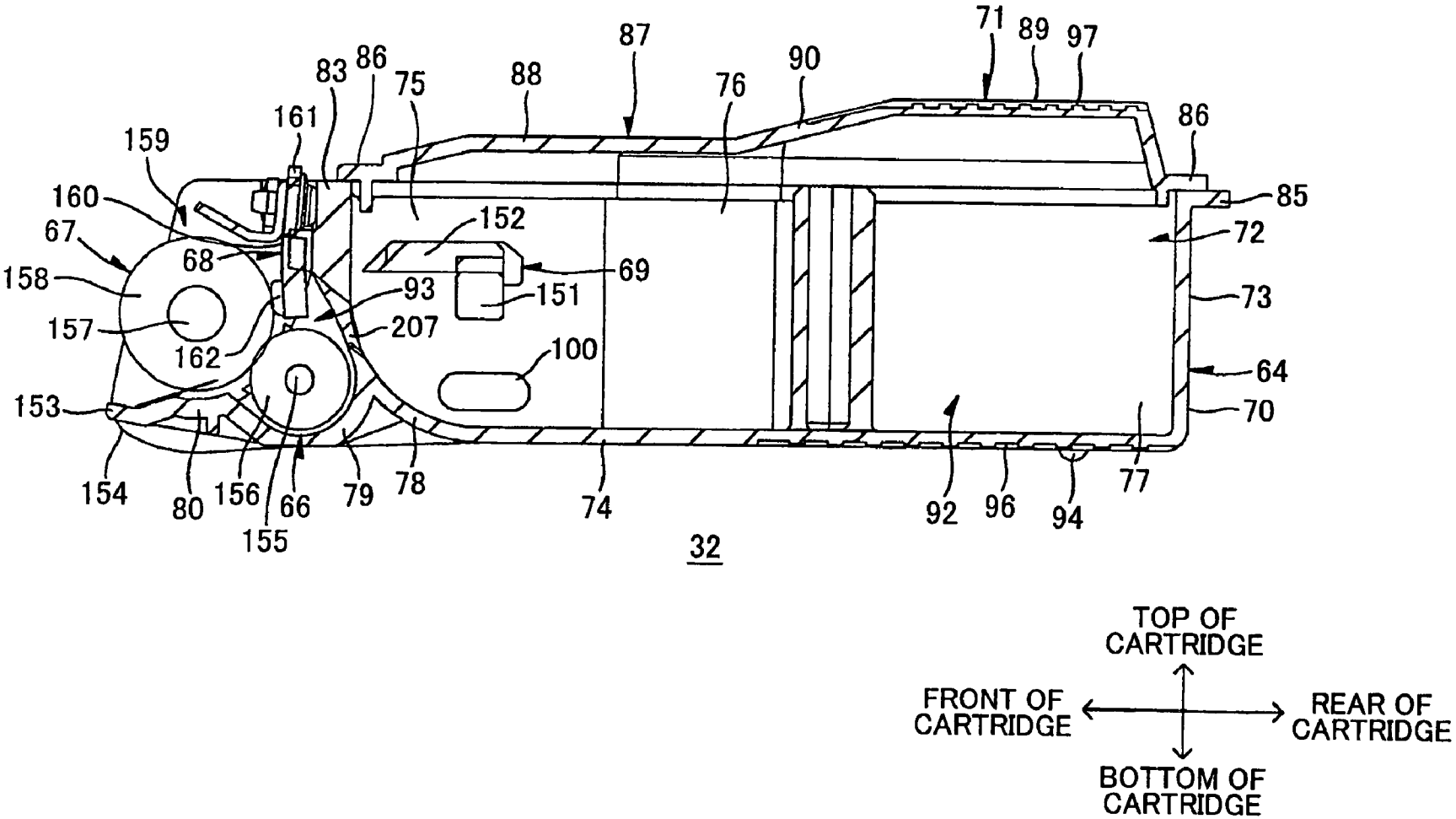
FIG. 26 is a side cross-sectional view of the developer cartridge according to a fifth embodiment.
Figure 27:
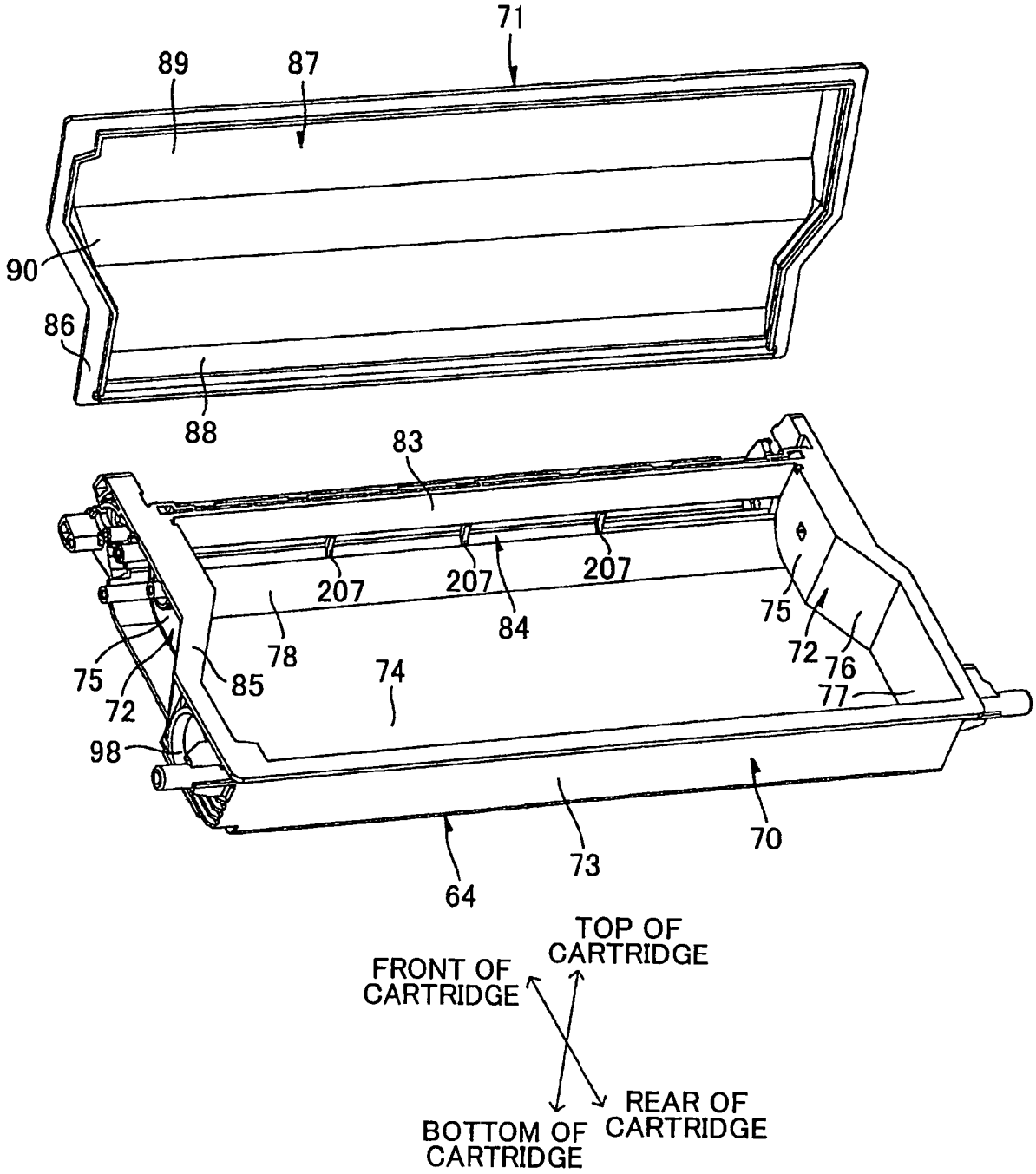
FIG. 27 is an exploded perspective view of the developer cartridge according to the fifth embodiment.

In the fourth embodiment described above, the reinforcing parts are formed by the reinforcing ribs 200 juxtaposed in the discharge opening 84. FIGS. 26 and 27 show the developer cartridge 32 according to a fifth embodiment of the present invention, wherein like parts and components are designated with the same reference numerals to avoid duplicating description. As shown in FIGS. 26 and 27, the reinforcing parts are configured of the partitioning wall 83, and connecting walls 207 provided in the discharge opening 84 and connecting the partitioning wall 83 to the front ends of the discharge wall 78.

More specifically, as shown in FIGS. 26 and 27, each of the connecting walls 207 is column-shaped and extends in the thickness direction of the developer cartridge 32. In the preferred embodiment, three of the connecting walls 207 are spaced at intervals in the widthwise direction. Each connecting wall 207 is formed such that the top surface side end of the connecting wall 207 is continuous with the end surface of the partitioning wall 83 on the bottom surface side, while the lower surface side end of the connecting wall 207 is continuous with the end surface on the top surface side of the connecting part between the front end of the discharge wall 78 and the rear end of the supply roller accommodating wall 79. The front surface of the connecting wall 207 is formed such that its top surface side end is flush with the front surface of the partitioning wall 83, and its bottom surface side end of the connecting wall 207 is flush with the front surface on the rear end of the supply roller accommodating wall 79.

In the developer cartridge 32 shown in FIGS. 26 and 27, the reinforcing parts configured of the partitioning wall 83 and the connecting walls 207 and spanning between the bottom wall 74 and top wall 87 are formed when the cover member 71 is closed over the casing member 70 so that the contact part 86 on the front side of the cover member 71 contacts the top surface of the partitioning wall 83.

The connecting walls 207 formed on the partitioning wall 83 in this way can reinforce the discharge opening 84, while enabling the smooth discharge of toner through the discharge opening 84. Hence, as described above, the connecting walls 207 can absorb stress applied to the top wall 87 and bottom wall 74 in the compressing direction, thereby improving the stiffness between the toner-accommodating chamber 92 and developing chamber 93. As a result, this construction can prevent the developer cartridge 32 from becoming dented or deformed and can prevent toner within the toner-accommodating chamber 92 from being accidentally ejected through the discharge opening 84 toward the developing roller 67.

In the fifth embodiment described above, the top surface side of the discharge opening 84 is closed by the partitioning wall 83 along the widthwise direction, while the connecting walls 207 partition the discharge opening 84 at intervals along the widthwise direction. Accordingly, the discharge opening 84 can be further reinforced to prevent deformation, while enabling the smooth discharge of toner.

Although the present invention has been described with respect to specific embodiments, it will be appreciated by one skilled in the art that a variety of changes may be made without departing from the scope of the invention.

For example, in the above-described first embodiment, the support post member 81 is provided on the bottom wall 74, while the cylindrical fitting part 91 is provided on the top wall 87 for fitting over the end of the support post member 81. However, the support post member 81 may be provided on the top wall 87, and the cylindrical fitting part 91 may be provided on the bottom wall 74 for fitting over the end of the support post member 81.

In the above-described embodiments, the fill through-hole 98 is located in one of the two opposite side walls 72. However, two fill through-holes 98 may be formed in both of the two opposite side walls 72.

The above-described embodiments are related to a tandem-type color laser printer 1 for directly transferring toner images from each photosensitive drum 42 to the paper 3, but the present invention is not limited to this device. For example, the present invention may be applied to an intermediate transfer-type color laser printer that transfers toner images in each color from the respective photosensitive members to an intermediate transfer member temporarily and subsequently transfers the entire color image to the paper. The present invention may also be applied to a monochrome laser printer.

What is claimed is:

1. A cartridge that can be detachably mounted in an image-forming device, the cartridge comprising:

a first wall;

a second wall opposing the first wall with a gap formed therebetween, the first wall and the second wall defining therebetween a developer-accommodating section that accommodates a developer; and a reinforcing part spanning between the first wall and the second wall, the reinforcing part including a supporting post member disposed on one of the first wall and the second wall and protruding toward the other, and a fitting member disposed on the other of the first wall and the second wall for fitting over the supporting post member.

2. The cartridge as claimed in claim 1, wherein the first wall and the second wall have peripheral edges, the cartridge further comprising a side peripheral wall disposed between the peripheral edges of the first wall and the peripheral edges of the second wall, wherein the reinforcing part is disposed in a position separate from the side peripheral wall.

3. The cartridge as claimed in claim 1, further comprising an agitator that is disposed in the developer-accommodating section and is driven to rotate to stir the developer, wherein the reinforcing part is positioned out of contact with the rotating agitator.

4. The cartridge as claimed in claim 3, wherein the agitator rotates around its axis to form a rotational path, and the reinforcing part is positioned without overlapping an area of the rotational path of the agitator projected along the axis.

5. The cartridge as claimed in claim 3, wherein the developer-accommodating section has a discharge opening formed to discharge developer; and the agitator is positioned near the discharge opening.

6. The cartridge as claimed in claim 1, wherein the first wall and the second wall each have an inner surface and an outer surface;

the outer surfaces of the first wall and second wall each have a grip region indicating part that informs the user where to grip the developer-accommodating section; and the reinforcing part spans between the inner surface of the first wall opposite the grip region indicating part provided on the outer surface of the first wall and the inner surface of the second wall opposing the grip region indicating part provided on the outer surface of the second wall.

7. The cartridge as claimed in claim 1, wherein the developer-accommodating section has a discharge opening formed to discharge developer; and the reinforcing part has a guiding surface on an upstream part of the reinforcing part with respect to the direction that developer is discharged through the discharge opening to guide the developer downstream in the discharging direction.

8. The cartridge as claimed in claim 7, wherein the reinforcing part is tapered toward the upstream side with respect to the discharging direction.

9. The cartridge as claimed in claim 1, wherein the developer-accommodating section has a fill through-hole that is used to introduce developer into the developer-accommodating section in a filling direction; and the reinforcing part is positioned without overlapping an extended line extending into the developer-accommodating section from the fill through-hole along the filling direction.

10. The cartridge as claimed in claim 9, further including an agitator, wherein the fill through-hole is positioned without overlapping the projected area of the agitator in the axial direction of the agitator.

11. The cartridge as claimed in claim 1, wherein the first wall and the second wall are substantially plate-shaped.

12. The cartridge as claimed in claim 1, wherein the developer-accommodating section has detection windows through which a detection light is transmitted for detecting a amount of residual developer in the developer-accommodating section; and the reinforcing part is positioned without overlapping an optical path of the detection light.

13. The cartridge as claimed in claim 1, wherein the distance between the inner surface of the first wall and the inner surface of the second wall in an upstream part of the developer-accommodating section with respect to a direction in which the cartridge is mounted is greater than a distance between the inner surface of the first wall and the inner surface of the second wall in a downstream part of the developer-accommodating section.

14. The cartridge as claimed in claim 1, wherein the second wall and the first wall further defines a developing section disposed adjacent to the developer-accommodating section and in fluid communication with the developer-accommodating, and the cartridge further comprising a developing roller that carries developer supplied from the developer-accommodating section, a portion of the developing roller being exposed through an opening formed between the second wall and the first wall.

15. The cartridge as claimed in claim 1, wherein the developer-accommodating section has a discharge opening that discharges developer; and the reinforcing part is disposed adjacent to the discharge opening.

16. The cartridge as claimed in claim 1, wherein the developer-accommodating section has a discharge opening that discharges developer; and the reinforcing part is disposed in the discharge opening.

17. The cartridge as claimed in claim 16, wherein the reinforcing part comprises:

a partition wall that closes a top surface side of the discharge opening along a longitudinal direction of the discharge opening; and linking walls disposed along the longitudinal direction of the discharge opening at prescribed intervals for linking the partition wall to the first wall.

18. A cartridge that can be detachably mounted in an image-forming device, the cartridge comprising:

a first wall:

a second wall opposing the first wall with a gap formed therebetween, the first wall and the second wall defining therebetween a developer-accomodating section that accommodates a developer, wherein the developer-accomodating section has a discharge opening formed to discharge developer;

a reinforcing part spanning between the first wall and the second wall;

an agitator that is disposed in t e developer-accommodating section and is driven to rotate to stir the developer, wherein the reinforcing part is positioned out of contact with the rotating agitator and the agitator is positioned near the discharge opening; and two side walls facing each other along the axial direction of the agitator and being separate from each other, wherein a distance between the side walls at a first position where the agitator is disposed is shorter than a distance between the side walls at a second position on the opposite side of the agitator from the discharge opening.

19. The cartridge as claimed in claim 18, wherein each of the side walls has a gap changing part that changes the distance between the side walls from the first position toward the second position, the gap changing part having a sloped surface that guides the developer in the discharging direction.

20. The cartridge as claimed in claim 18, wherein a fill through-hole is formed in at least one of the side walls at the second position.

21. An image-forming device, comprising:

a housing; and a cartridge that is detachably mounted in the housing, the cartridge comprising;

a first wall;

a second wall opposing the first wall with a gap formed therebetween, the first wall and the second wall defining therebetween a developer-accommodating section that accommodates a developer; and a reinforcing part spanning between the first wall and the second wall, the reinforcing part including a supporting post member disposed on one of the first wall and the second wall and protruding toward the other, and a fitting member disposed on the other of the first wall and the second wall for fitting over the supporting post member.

22. The image-forming device as claimed in claim 21, wherein the developer-accommodating section has a discharge opening that discharges developer; and the cartridge is oriented in the housing to allow developer accommodated in the developer-accommodating section to shift toward the discharge opening by its own weight.

23. The image-forming device as claimed in claim 22, wherein the cartridge comprises an agitator that is located in the developer-accommodating section and that is driven to rotate to stir toner accommodated in the developer-accommodating section, the agitator being disposed above the discharge opening when the cartridge is mounted in the housing.

24. The image-forming device as claimed in claim 23, wherein the cartridge comprises a developing roller that carries a developer; and a supply roller that supplies developer accommodated in the developer-accommodating section onto the developing roller;

wherein the developing roller and the supply roller are disposed below the developer-accommodating section when the cartridge is mounted in the housing.

25. The image-forming device as claimed in claim 24, wherein the agitator comprises a rotational shaft, and an agitating member provided on the rotational shaft;

wherein a vertical line extending downward from the rotational shaft intersects a line segment linking a shaft of the developing roller to a shaft of the supply roller when the cartridge is mounted in the housing.

26. The image-forming device as claimed in claim 21, wherein the cartridge includes a plurality of cartridges corresponding to a plurality of colors.

27. An image-forming device as claimed in claim 26, further comprising:

a feeding unit that picks up and feeds a recording medium;

a conveying unit that conveys the recording medium along a conveying path; and discharging unit that discharges the recording medium from the housing;

wherein the plurality of cartridges are disposed between the feeding unit and the discharging unit along the conveying path;

a pickup direction in which the feeding unit picks up the recording medium is opposite a conveying direction in which the conveying unit conveys the recording medium through the housing to form images sequentially with the plurality of cartridges; and the conveying direction is opposite a discharge direction in which the discharging unit discharges the recording medium from the image-forming device.

28. An image-forming device as claimed in claim 27, wherein the cartridges are mounted in and removed from the housing in a direction that is slanted both with respect to the conveying direction and a thickness direction of the recording medium orthogonal to the conveying direction.

29. An image-forming device as claimed in claim 27, further comprising a plurality of exposing devices corresponding to the plurality of cartridges, the plurality of cartridges being arranged in an alternating relationship with the corresponding exposing devices along the conveying direction for conveying the recording medium through the image-forming device.

30. An image-forming device, comprising:

a housing; and a cartridge that is detachably mounted in the housing, the cartridge comprising;

a first wall;

a second wall opposing the first wall with a gap formed therebetween, the first wall and the second wall defining therebetween a developer-accommodating section that accommodates a developer, the developer-accommodating section having a discharge opening formed to discharge developer;

a reinforcing part spanning between the first wall and the second wall;

an agitator that is disposed in the developer-accommodating section and is driven to rotate to stir the developer, the agitator being positioned near the discharge opening and the reinforcing part being positioned out of contact with the rotating agitator; and two side walls facing each other along the axial direction of the agitator and being separate from each other, wherein a distance between the side walls at a first position where the agitator is disposed is shorter than a distance between the side walls at a second position on the opposite side of the agitator from the discharge opening.

31. The image-forming device as claimed in claim 30, wherein each of the side walls has a gap changing part that changes the distance between the side walls from the first position toward the second position, the gap changing part having a sloped surface that guides the developer in the discharging direction.

32. The image-forming device as claimed in claim 30, wherein a fill through-hole is formed in at least one of the side walls at the second position.

* * * * *